US008974325B1

(12) United States Patent
Zucca et al.

(10) Patent No.: US 8,974,325 B1
(45) Date of Patent: Mar. 10, 2015

(54) SOCCER BOX

(71) Applicants: Matthew Zucca, Belmont, CA (US); Andres Deza, Belmont, CA (US)

(72) Inventors: Matthew Zucca, Belmont, CA (US); Andres Deza, Belmont, CA (US)

( * ) Notice: Subject to any disclaimer, the term of this patent is extended or adjusted under 35 U.S.C. 154(b) by 57 days.

(21) Appl. No.: 13/797,947

(22) Filed: Mar. 12, 2013

Related U.S. Application Data

(60) Provisional application No. 61/615,135, filed on Mar. 23, 2012, provisional application No. 61/724,779, filed on Nov. 9, 2012.

(51) Int. Cl.
*A63B 69/00* (2006.01)

(52) U.S. Cl.
CPC ..... *A63B 69/0097* (2013.01)
USPC ..... 473/434; 473/446; 473/471; 473/478

(58) Field of Classification Search
USPC ..... 473/422, 421, 415, 446, 434, 478; D21/699, 706; 472/92–94
See application file for complete search history.

(56) References Cited

U.S. PATENT DOCUMENTS

| | | | | |
|---|---|---|---|---|
| 408,810 | A * | 8/1889 | Moore | 217/122 |
| 2,581,318 | A * | 1/1952 | Bartlett | 119/514 |
| 3,338,579 | A * | 8/1967 | McKain | 473/188 |
| 3,478,914 | A * | 11/1969 | Williams | 220/4.28 |
| 4,662,532 | A * | 5/1987 | Anderson et al. | 220/7 |
| 5,000,461 | A * | 3/1991 | Borazjani | 473/476 |
| 5,221,243 | A * | 6/1993 | Walker | 482/83 |
| 5,638,973 | A * | 6/1997 | Dewey et al. | 220/4.33 |
| D444,628 | S * | 7/2001 | Schwarz | D3/304 |
| 6,553,940 | B1 * | 4/2003 | Powell et al. | 119/514 |
| 7,001,288 | B2 * | 2/2006 | Harrell | 473/446 |
| 7,293,530 | B2 * | 11/2007 | Italiano | 119/498 |
| 7,597,558 | B2 | 10/2009 | Mazloompour | |
| 7,909,330 | B2 | 3/2011 | Domjen | |
| D652,462 | S * | 1/2012 | Sun | D21/706 |
| D704,285 | S * | 5/2014 | Zucca et al. | D21/699 |
| 2002/0022540 | A1 * | 2/2002 | Slomski et al. | 473/478 |
| 2003/0056907 | A1 * | 3/2003 | Caveney et al. | 160/135 |
| 2004/0176193 | A1 | 9/2004 | Valliquette | |
| 2005/0192125 | A1 * | 9/2005 | Valliquette | 473/446 |
| 2008/0261727 | A1 * | 10/2008 | Snyder | 473/435 |
| 2008/9026172 | | 10/2008 | Snyder | |
| 2009/0069125 | A1 | 3/2009 | Porter | |
| 2010/0175632 | A1 * | 7/2010 | Groh | 119/474 |

* cited by examiner

*Primary Examiner* — Mitra Aryanpour
(74) *Attorney, Agent, or Firm* — Aka Chan LLP

(57) ABSTRACT

A portable, lightweight soccer rebounding wall with good rebound characteristics, whereby the pace of the rebounding soccer ball is similar to that of the pace at which it was imparted against the wall. The system is easily assembled and disassembled and is sufficiently light to be carried by one person for several hundred yards. In a specific implementation, the rebounding wall includes a panel of pultruded, fiberglass cross bar grating.

20 Claims, 19 Drawing Sheets

SOCCER BOX

CROSS-REFERENCE TO RELATED APPLICATIONS

This application claims the benefit of U.S. provisional patent applications 61/724,779, filed Nov. 9, 2012, and 61/615,135, filed Mar. 23, 2012, which are incorporated by reference along with all other references cited in this application.

BACKGROUND OF THE INVENTION

This invention relates to athletic equipment and more specifically, to a soccer rebounding wall.

The number of youth soccer players in the United States has doubled, to over four million players since 1990, according to the United States Soccer Federation. At the same time, the number of high school soccer players has more than doubled since 1990, to 730,106 athletes, the fastest growth rate among any major sport, according to statistics compiled by the Sporting Goods Manufacturers Association. This has lead to an increase in the interest level for devices and equipment, to better train players of the sport.

For some of the training, rebounders are used. For example, elastic nets to rebound balls or shapes with vertical walls that are made of materials that are either unspecified or are excessively heavy. The elastic net rebounders function in a different manner and are usually used for passing and returning the ball in the air, not along the ground surface. Sometimes, a vertical wall can be used to rebound a ball.

A problem with elastic net rebounders is that they are generally limited to the passing and returning of the ball in the air. In soccer, their primary purpose is to either return a soccer ball after a kick to avoid having to collect the balls from a typical goal or to work on aerial control of the soccer ball as it is returned to the player in the air. Elastic net rebounders do not provide any training for passing along the ground.

Rebounders with vertical walls are either excessively heavy (in order to have sufficient mass to achieve appropriate rebound effects). As a result of the weight, the vertical wall rebounders are excessively heavy and impractical for regular use by coaches during practices. They also do not provide rebound characteristic comparable to a ball being struck against a wall.

Therefore, an improved soccer rebounding structure is needed.

BRIEF SUMMARY OF THE INVENTION

There has been a need to develop a useable soccer-training device capable of being truly portable and easy to assemble in the field while providing key characteristics, in particular rebounding or return of a soccer ball upon striking a generally vertical or even slightly inclined panel or wall. Products that achieve appropriate rebound characteristics are either (1) heavy and not portable or (2) portable but require the addition of weight to provide mass to the product in order for proper function.

In an embodiment, the system includes a product that is a square box with vertical walls used to rebound soccer or other sports balls. The product is manufactured with fiberglass reinforced plastic ("FRP") grating, which could be of various thicknesses, depths, and resins with the attachments between the vertical walls occurring at the end of each wall. Cross-bracing between parallel walls can also be used to enhance wall stiffness.

In an implementation, the product can have one or more of the following characteristics: (1) very light weight, (2) can be assembled and disassembled quickly and easily, (3) can be easily placed into a carrying bag for transport, (4) can be used by four players at the same time or more players as part of exercises, (5) has exceptional soccer ball rebound characteristics, (6) develops over-ground passing skills and associated underling psychomotor, coordination, and technical skills, and (7) provides for consistency in over-ground passing testing and assessment skills across teams and players.

In an implementation, the product is a four-sided, square-shaped structure with four vertical walls connected to each other at each end. The product does not necessarily have either a top or bottom portion to the structure. Connection of the walls involves the use of fasteners and connectors that hold the walls tightly together. A gasket is placed between each wall-to-wall connection in order to help improve the stability of the connection.

As an added feature to the product, a flexible, elastic net can be connected at the top of the vertical walls and extend toward the ground at an angle where the bottom of the net is secured to the ground using ground stakes or other devices. Through the use of the product, a player will be able to develop certain key psychomotor and coordinative skills that are necessary for the successful development of a soccer player.

In an implementation, a device consists of multiple walls of FRP grating joined at the ends of the wall. The FRP walls can be made with different openings of different widths, lengths, and depths as well as various types of resins and quantities of fiberglass and still maintain the desired characteristics. The FRP grating is cut in such a manner that either the top or bottom (or both) of the box has been made in the middle of the opening of the FRP grating such that there remains a series of protrusions from the remaining portions of the FRP grating. These protrusions are then, when assembled, placed on the top and bottom for use in resisting the lateral forces imparted on the project.

Alternatively, the walls can be cut flush with the horizontal portions of the FRP grating such that there are no protrusions so that the product can be used indoors. In such a manner, the product could have rubber, non-skid placed along the bottom of the box.

Additionally, the use of FRP plastic, which is not entirely solid and contains openings in the material, makes the product lighter than other products made of solid materials, such as wood. The FRP also has flexible material characteristics that, when coupled with the method of construction of the product, results in a solid rebound characteristic for balls struck against it. In a specific implementation, there are also tensioning rods that further enhance the rebound characteristics of the product.

By constructing the wall joints with nut, bolt, handle/knob, and cam lever assemblies, the walls can be easily assembled and disassembled. Additionally, in a specific implementation, once the joining assemblies have been removed, hinges could be mounted on the corners of two of the walls allow the box to be separated into two parts and folded together to enhance its portability.

In an implementation, the system includes a device for soccer training including: a first, second, third, and fourth panel, each panel including: a grating including a plurality of bars extending in a first direction and forming a relatively planar front surface, a first end formed by the plurality of bars, and a second end, opposite the first end, formed by the plurality of bars; a first mounting bracket is affixed to a first end of the first panel; a first cross bracket and a first angle bracket, where the first cross bracket and the first angle bracket forms a first slot; and a tightening mechanism coupling the first cross bracket and the first angle bracket including: in a non-tightened position, the first cross bracket and the first angle bracket is ready to receive a first end of a second panel; and in a tightened position, the first cross bracket and the second angle bracket receives and clasps a first end of the second panel at the first slot.

The product can include where the front surface of the first panel is adapted to receive a kicked ball in a landscape position. The product can include where for each of the panels, the plurality of bars are approximately parallel with respect to each other. The product can include where each panel includes a plurality of panel supports, where the panel supports extend in a second direction, perpendicular to the first direction.

In an implementation, the product includes where for a first panel, the panel supports are at a rear surface of the first panel, opposite of a front surface of the first panel. The product can include where the plurality of panel supports are adapted to be driven into a ground surface. The product can include where none of the panel supports are positioned at the first or second ends. The product can include a cam lever. The product can include where in the non-tightened position, the cam lever continues to couple the first cross bracket and the first angle bracket. The product can include where the panels have an elastic constant of a fixed-end beam upon impact at a first front surface of the first panel.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
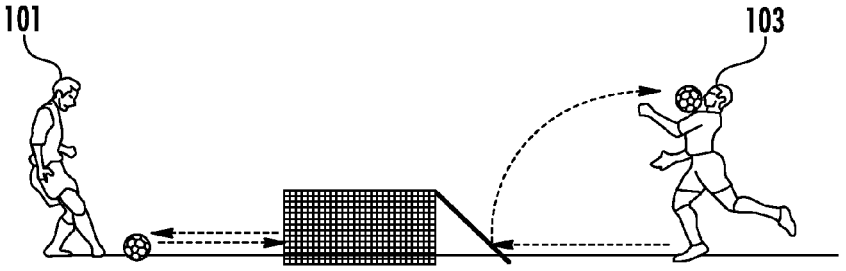
FIG. 1 shows a product in use.

The product can be constructed from four panels of fiber-reinforced plastic ("FRP") grating covered with a fiber-reinforced plate. In general, the product can roughly measure between about 12 inches to about 36 inches high and 2 feet to 4 feet wide depending upon the desired dimensions and weight of the product. The FRP can be manufactured using a number of combinations of different fibers and plastic resins and can be molded or pultruded, as discussed in additional detail below. However, the characteristics of the product is its ability to effectively rebound a soccer ball either along the ground or in the air.

In an implementation, the product is intended to assist in the training and development of many of the skills needed for playing soccer. In soccer, players require different athletic abilities play the game. These athletic abilities can generally be grouped into the following skills categories: (1) Psychomotor, (2) Coordination, (3) Technical, (4) Physical, and (5) Tactical. Some further examples of these are discussed following:

(1) Psychomotor skills are those that involve: Basic motor schemes (e.g., run, jump, throw, and catch), Postural schemes (e.g., bend, roll, and abduct/adduct), Sensory Perceptive Skills (e.g., kinesthetic channels, sight, hearing, and touching), and Pre-Acrobatic skills (e.g., summersault, cartwheel, and handstand).

(2) Coordination skills are more specialized to the sport in questions (e.g., soccer) and based upon and built from the psychomotor skills development and involve a combination of more than psychomotor skill. The coordination skills are generally considered to be: Combining Movements, Spatial-Temporal Orientation, Differentiation, Reaction, Balance (Static and Dynamic), Adaptation-Transformation, Rhythm, Anticipation, and Motor Imagination.

(3) Technical abilities are, in turn, based upon combinations of coordinative abilities and are more specialized to the sport in question. Technical soccer abilities can be broken down into the following three main phases of development, which are also are in order of player development. The technical abilities, and their associated coordinative requirements in their order of priority are the following three phases:

First Phase. Juggling: Balance, Rhythm, Differentiation; Passing and Receiving: Combining Movements; Adaptation: Transformation; Spatial-Temporal Orientation. Dribbling: Dynamic Balance, Differentiation, Rhythm.

Second Phase. Long Passing: Adaptation-Transformation, Spatial-Temporal Orientation, Combining Movements; Shooting: Differentiation, Adaption-Transformation, Spatial-Temporal Orientation; 1 versus. 1 Play: Adaption-Transformation, Anticipation, Motor Imagination.

Third Phase. Heading: Balance, Differentiation, Spatial-Temporal Orientation; Faking: Reaction, Adaption-Transformation, Anticipation, Motor Imagination; Tackling: Adaption-Transformation, Spatial-Temporal Orientation, Combining Movements.

In other words, younger players should spend significantly more time practicing passing and receiving than on shooting or heading, which are considered a more advanced skills.

Physical and Tactical abilities represent a more substantial portion of the total training hours for older players, however continued deliberate practice on the basic underlying technical abilities (e.g., passing and receiving) is necessary.

Additionally, when the product is being used by the player, the rebound trajectory and speed of the ball is purely a function of the player's initial contact with the ball, therefore the player receives immediate feedback as to whether the ball was struck as intended based upon the rebound trajectory and speed. In order to make a return pass, the player must then:

(1) Observe the rebounding ball's speed and trajectory (Sensory Perception), (2) Decide how best to make body movements to adapt to the ball trajectory (Reaction), (3) Transform body position to the appropriate location in time and space while maintaining balance to appropriately receive the ball (Adaptation and Transformation and Dynamic Balance), (4) Utilize fine motor skills to strike the ball in the appropriate direction and strength to obtain the desired resulting trajectory and speed (Differentiation), and (5) Observe whether all of the above efforts resulted in a successful return pass of the ball in order to receive the subsequent rebound (Sensory Perception).

All of the above must occur within a very limited amount of time and involves many of the psychomotor and coordinative abilities younger soccer players need for appropriate development of more complex, technical skills and older players need for skills maintenance.

The product is placed on the ground and used by players to strike the ball against the vertical walls and receive the rebounding soccer ball. The product is intended to help in the development of the psychomotor skills and coordination necessary to effectively strike and receive soccer balls using any combination of feet or number of touches to control the ball and at varying distances from the face of the wall. Some of the psychomotor and coordination skills developed through the use of the product include:

1. Balance.

2. Awareness of the body in space and time (Space-Time Orientation).

3. Awareness of the amount of effort to impart on the ball to achieve the desired rebound (Differentiation).

4. Rhythm.

Based upon the development of these psychomotor and coordinative skills through the use of the product, it is intended that a player will develop increased skill at passing and receiving a soccer ball.

Generally, there are very few solid wall rebounders available on the market. The vast majority of the rebounder market consists of rebounders using elastic nets. Two specific rebounders are:

SoccerWave. Consists of a combination aerial return and flat panel rebounder. However, the product is manufactured from high-density polyethylene and must be filled with water for adequate performance and rebound characteristics. Additionally, the SoccerWave has very limited portability, even if the water is removed, because it is not collapsible like the product.

Ball Wall. Consists of a series of large, thick wooden walls that use the mass of the wood to generate the appropriate rebounding effect. The Ball Wall also includes an inclined plane aspect for aerial return of the ball, like much of the other prior art, but the Ball Wall is not easily portable given its materials of construction, size, and weight. Table 1 describes sample rebounders.

TABLE 1

Sample Rebounders

| Product/Manufacturer | Product | Primary Category |
|---|---|---|
| SoccerWave | Soccer Wave XP | Solid Rebounder |
| | XP Kickback Panel | Solid Rebounder |
| Ball Wall | Small Wall | Solid Rebounder |
| | Large Wall | Solid Rebounder |
| | Technique Wall | Solid Rebounder |
| Matrix Sports Group | Quick Feet | Net Rebounder |
| Sportwerkx All Ball Pro | Premier 5 ft | Net Rebounder |
| | Elite 7 ft | Net Rebounder |
| | Ultimate 9 ft | Net Rebounder |
| Goalrilla | Striker | Net Rebounder |
| | All-Season | Net Rebounder |
| | G-Trainer | Net Rebounder |
| Tekk | Rebounder | Net Rebounder |
| Victory | Rebounder | Net Rebounder |
| Franklin Sports | MLS X Ramp | Net Rebounder |
| | Tournament Soccer Rebounder | Net Rebounder |
| | Adjustable Training Soccer | Net Rebounder |
| Train Smart | 3 × 4 ft | Net Rebounder |
| | 4 ft × 6 ft | Net Rebounder |
| | 6 ft × 6 ft | Net Rebounder |
| | 6 × 8 ft | Net Rebounder |
| EZ Goal | 6 in 1 Pro Goal | Net Rebounder |
| Trigon Sports | Soccer Rebounder | Net Rebounder |
| Mitre | Soccer Rebounder | Net Rebounder |
| | 3 in 1 Trainer | Net Rebounder |
| Bownet | Portable Barrier Net | Net Rebounder |
| Park & Sun | Pro Rebounder | Net Rebounder |
| PowerBack | Trainer | Net Rebounder |
| SSG/BSN 1282481 | Rebounder | Net Rebounder |
| Agora | Adjustable Rebounder | Net Rebounder |
| Kwik Goal | AFR-1 | Net Rebounder |
| | AFR-2 | Net Rebounder |
| | Kick Back | Net Rebounder |

As can be seen from the available market for soccer rebounders, none match the description of the product and provide all the key characteristics identified above. As such, there has been little capability with the existing art to develop commercially successful wall rebounders and the majority of the market has focused on net rebounders because they are lighter in weight and, in some instances, they are also portable. Some specific systems are discussed below:

A first system contains multiple vertical panels for use by multiple players at the same time in order to develop soccer skills. Configurations could include a multitude of panels and geometric configurations and the panels could be stacked flat for easier transportation. Connection details are identified, but all connections consist of screwed fittings that would be tedious and time consuming to assemble and disassemble in the field. This system identifies several potential materials, including plastic, but did not identify the inherent properties such as those contained in pultruded or molded FRP.

A second system contains multiple vertical panels for use by multiple players at the same time in order to develop soccer skills. Connections consisted of a pin hinge system to allow for configuration of the portable walls in multiple configurations. As discussed further below, pin hinge systems do not transfer bending moment and therefore must rely on the weight of the panel and the rear support to provide for adequate rebound effect. Such systems are inherently non-portable.

A third system contains portable walls that have a pin hinge system to allow for configuration of the portable walls in multiple configurations. As discussed further below, pin hinge systems do not transfer bending moment and therefore must rely on the weight of the panel and the rear support to provide for adequate rebound effect.

A fourth system contains a singular, vertical panel with rear support legs that fold into the rear of the panel mold for portability. The single wall nature of this product limits the scope of its use.

A fifth system contains a singular rebound wall with rear support legs to support the wall in a general vertical position containing an upper and lower portion at different angles to the vertical plane for different rebound characteristics depending upon where the ball was struck against the panel. The single wall nature of this product limits the scope of its use.

A sixth system contains a concave ramp with a lower and upper edge such that a ball traveling along the concave ramp surface from the lower edge to the upper edge would re-direct the ball back to the player at varying heights depending upon the location the ball was struck against the device along the axis perpendicular to the motion of the ball. The rear side of the device contained a vertical wall for aerial return of the ball to the player. However, this product cannot be collapsed such that it can be transported to and from the field for use.

A seventh system is a training device consisting of rebound surfaces set at different angles consisting of a hollow shell that is fillable with water to add weight such as water or sand. As identified above, the requirement that the product be filled with water substantially limits its portability to and from the field.

Additionally, even among other rebounders available on the market, there is a wide range in price. In some instances, there is no identifiable, incremental value over other products that have much lower price points.

FIG. 1 shows some sample use of the product. For player 101, the ball is rebounded on the ground back to user 101. When using the added net feature for the product, the rebounding soccer ball is intended to return to the player in the air such a manner that the player must control an aerially delivered ball. This is shown by player 103. By including aerial return of the ball to the player, the use of the product further assists in the development of psychomotor and coordinative skills by introducing other parts of the body into the biomechanical responses needed to control the soccer ball.

Figure 2:
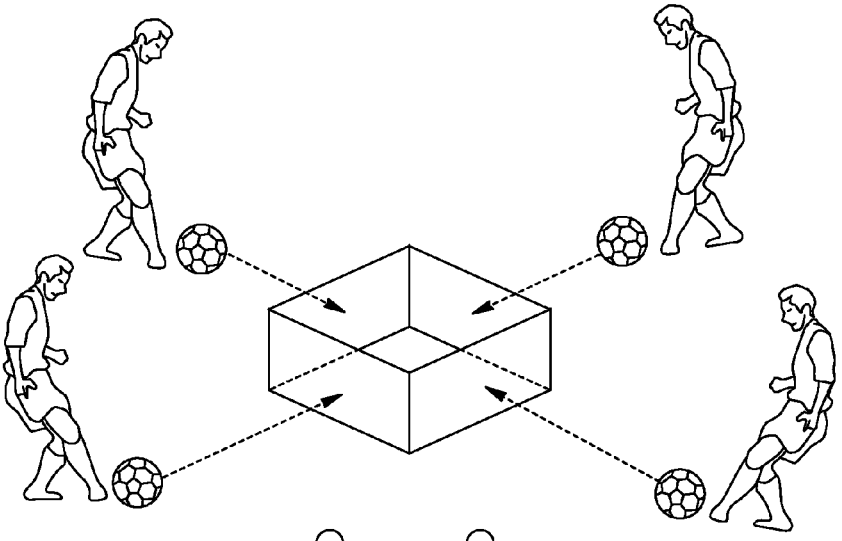
FIG. 2 shows four walls of a product in use.

FIG. 2 shows the product used by more than one user. Given the multi-faceted aspect of the product and its characteristics, the product can be used on all four sides simultaneously with either the wall or rebounding net.

Figure 3:
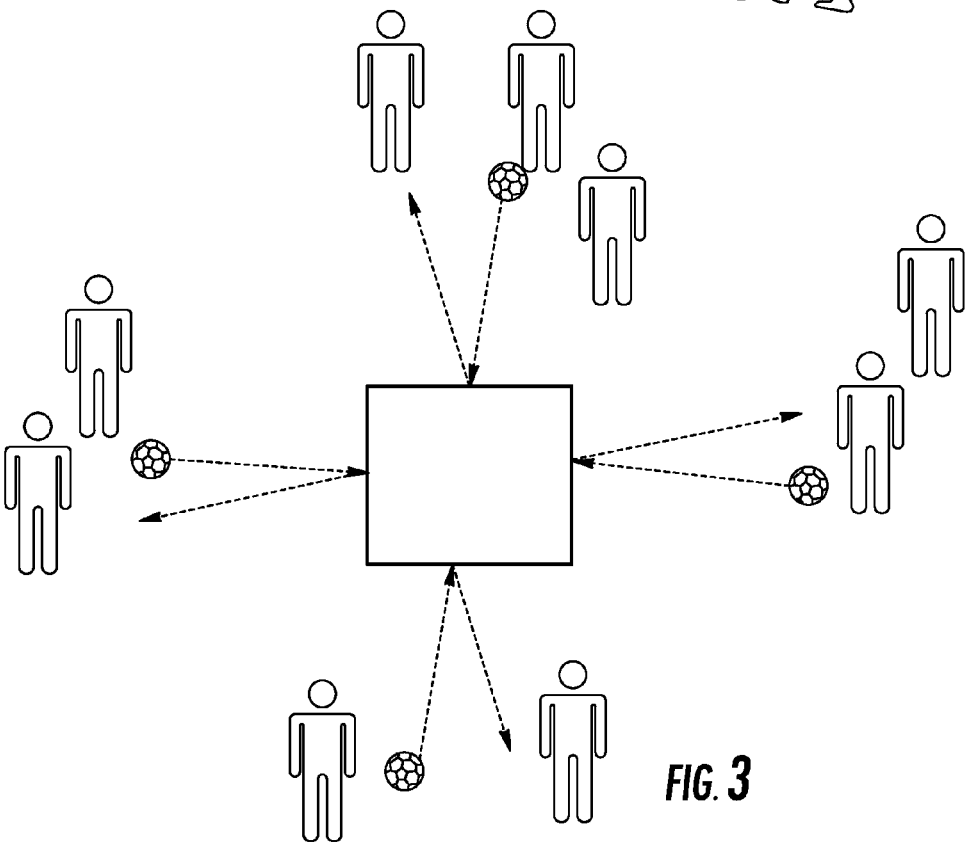
FIG. 3 shows two people per side using the product.

Beyond these uses of the product, which involve the development of individual psychomotor and coordinative skills, the product can also be utilized as part of other exercises involving multiple players interacting with each other as well as with the product. FIG. 3 shows an example of such an exercise where partners are using each of the four walls to pass and receive rebounding balls. Multiple additional exercises can be developed for use with the product beyond those described above.

In an implementation, the system uses fiber-reinforced plastic (also fiber-reinforced polymer) composite material made of a polymer matrix reinforced with fibers. The fibers are usually glass, carbon, or aramid, although other fibers such as paper or wood or asbestos have been sometimes used. The polymer is usually an epoxy, vinylester or polyester thermosetting plastic, and phenol formaldehyde resins are still in use.

FRPs are a category of composite plastics that specifically use fibrous materials to mechanically enhance the strength and elasticity of plastics. The original plastic material without fiber reinforcement is known as the matrix. The matrix is a tough but relatively weak plastic that is reinforced by stronger stiffer reinforcing filaments or fibers. The extent that strength and elasticity are enhanced in a fiber-reinforced plastic depends on the mechanical properties of the fiber and matrix, their volume relative to one another, and the fiber length and orientation within the matrix.

Reinforcement of the matrix occurs by definition when the FRP material exhibits increased strength or elasticity relative to the strength and elasticity of the matrix alone. FRP composites are anisotropic (properties apparent in the direction of the applied load) whereas steel or aluminum is isotropic (uniform properties in all directions, independent of applied load). Therefore, FRP composite properties are directional, meaning that the best mechanical properties are in the direction of the fiber placement. Composites are similar to reinforced concrete where the rebar is embedded in an isotropic matrix called concrete.

However, when constructed in a grid like manner with varying thicknesses, an FRP composite can behave isotropically and perform in a manner similar to that of metals but with its own unique characteristics.

Composites are composed of:

Resins. The primary functions of the resin are to transfer stress between the reinforcing fibers, act as a glue to hold the fibers together, and protect the fibers from mechanical and environmental damage. The most common resins used in the production of FRP grating are polyesters (including orthophthalic (or ortho) and isophthalic (or iso)), vinyl esters and phenolics.

Reinforcements. The primary function of fibers or reinforcements is to carry load along the length of the fiber to provide strength and stiffness in one direction. Reinforcements can be oriented to provide tailored properties in the direction of the loads imparted on the end product. The largest volume reinforcement is glass fiber.

Fillers. Fillers are used to improve performance and reduce the cost of a composite by lowering compound cost of the significantly more expensive resin and imparting benefits as shrinkage control, surface smoothness, and crack resistance.

Additives. Additives and modifier ingredients expand the usefulness of polymers, enhance their processability or extend product durability each of these constituent materials or ingredients play an important role in the processing and final performance of the end product.

In this section, those manufacturing processes typically used to make products found the grating market are covered. Unique to the composites industry is the ability to create a product from many different manufacturing processes. There are a wide variety of processes available to the composites manufacturer to produce cost efficient products.

Pultrusion Grating Process. Pultrusion is a continuous process for manufacturing composites that have a cross-sectional shape. The process consists of pulling a fiber-reinforcing material through a resin impregnation bath and through a shaping die. The dimensions and shape of the die will define the finished part being fabricated. Inside the metal die, heat is transferred initiated by precise temperature control to the reinforcements and liquid resin. The heat energy activates the curing or polymerization of the thermoset resin changing it from a liquid to a solid. The solid laminate emerges from the pultrusion die to the exact shape of the die cavity. The laminate solidifies when cooled and it is continuously pulled through the pultrusion machine and cut to the desired length. The process is driven by a system of caterpillar or tandem pullers located between the die exit and the cut-off mechanism.

Molding Grating Process. Molded grating is manufactured in an open, heated mold that resembles a large waffle iron. Continuous glass fibers are placed in the mold in alternating layers and thoroughly wetted out with resin. This continuous process produces an integral, one-piece construction, which offers excellent corrosion resistance as well as bi-directional strength. When the weaving process is completed, the mold is heated to cure the panel. If the grating is to have embedded grit, the mold will receive the grit at this time before the part is cured. After curing, the part is extracted from the mold. The standard part would have a meniscus (concave) top surface for slip resistance. Should a standard grit surface be specified, the grit would be bonded to the top of the completed grating panel as a secondary operation.

Some specific methods of manufacturing the system (or specifications) are presented in this application, but it should be understood that the invention is not limited to the specific steps and specification details presented.

An example of a specification for the product would be as follows:

1. Mesh Size: 1.5 inches by 1.5 inches
2. Load Bar Depth: 0.75 inches to 1.5 inches
3. Mesh Style: Square
4. Color: Gray
5. Grating Cover Plate: 0.125 inch
6. Resin: Type GP (or general purpose) Orthophthalic Polyester
7. Glass: "E" Type
8. Gratings can be fabricated free from warps, twists, or other defects which affect appearance and serviceability.
9. All shop fabricated grating cuts can be coated with a resin comparable to grating resin.
10. The grating can be one piece construction with the tops of the bearing bars and cross bars in the same plane.
11. The FRP molded grating can be manufactured by the open mold process.
12. Aspect ratio can be 35 percent fiberglass and 65 percent resin.
13. Grating cover plate 13a. Grating can be the same as described above in this section.

13b. The cover plate for molded grating can be an integrally molded plate.

13c. The integrally molded plate may use the same resin as the grating.

13d. The integrally molded plate can be bonded to the grating, and can contain a smooth or slightly textured finish.

Additionally, the plating could occur after the molding process by using a bonding compound, such as epoxy, to secure the FRP plate to the FRP grating.

In an implementation, the system uses a pultrusion process to manufacture portions of the system. Pultrusion is a continuous process for manufacturing composites that have a constant cross-sectional shape. The process consists of pulling a fiber-reinforcing material through a resin impregnation bath and through a shaping die. The dimensions and shape of the die will define the finished part being fabricated. Inside the metal die, heat is transferred initiated by precise temperature control to the reinforcements and liquid resin. The heat energy activates the curing or polymerization of the thermoset resin changing it from a liquid to a solid. The solid laminate emerges from the pultrusion die to the exact shape of the die cavity. The laminate solidifies when cooled and it is continuously pulled through the pultrusion machine and cut to the desired length. The process is driven by a system of caterpillar or tandem pullers located between the die exit and the cut-off mechanism.

Pultrusion is a continuous process for manufacturing composites that have a constant cross-sectional shape. The process consists of pulling a fiber-reinforcing material through a resin impregnation bath and through a shaping die. The dimensions and shape of the die will define the finished part being fabricated. Inside the metal die, heat is transferred initiated by precise temperature control to the reinforcements and liquid resin. The heat energy activates the curing or polymerization of the thermoset resin changing it from a liquid to a solid. The solid laminate emerges from the pultrusion die to the exact shape of the die cavity. The laminate solidifies when cooled and it is continuously pulled through the pultrusion machine and cut to the desired length. The process is driven by a system of caterpillar or tandem pullers located between the die exit and the cut-off mechanism.

The benefit of pultruded fiberglass over molded fiberglass or other types of plastics that do not contain fiber reinforcement, is that pultruded fiberglass contains approximately 65 percent glass and 35 percent resin, which makes it much stiffer than molded fiberglass, which contains approximately 35 percent glass and 65 percent resin. Other types of plastics, such as polyvinyl chloride or high-density polyethylene used in other products, do not benefit from the strengthening effect of the fibers.

Some relevant terms used in the fabrication of pultruded fiberglass include the following:

Fiberglass: The process typically starts by pulling in two forms of fiberglass reinforcement. Creels of fiberglass roving provide unidirectional strength along the length of the profile, and rolls of woven fiberglass mat provide multidirectional reinforcement.

Wetout: The fiberglass reinforcements are pulled through a bath of thermoset resin, typically polyester or vinylester. Excess resin is then removed to expel any trapped air and to compact the fibres. The impregnated reinforcement is passed through preforming guides to align the reinforcement before the application of a surface veil.

Surface Veil Just before all the material is pulled into the heated die, surface veil may be added to enhance the surface appearance of the final product.

Curing: Wet-out reinforcements are pulled through the heated die, which causes the resin to "cure" or harden. The temperature of the die is carefully controlled to ensure that the composite is fully cured. By the time the part exits the die, a solid, rigid profile in the exact shape of the die cavity has been formed with all the reinforcements laminated inside.

Cutting: The finished product is then pulled to the cut-off saw and cut to the desired length.

An example of a specification for the product using pultruded grating is as follows:

1. FRP products can be manufactured using a pultruded process utilizing polyester or vinyl ester resin with flame retardant and ultraviolet inhibitor additives.
2. Color: Black
3. The panels can include T-bars or I-bars and can be about 1-1.5 inches deep and sustain a deflection of no more than about 0.15 inches under a concentrated load of about 200 pounds per square foot for the about 36-inch span.
4. The glass fiber reinforcement for the bearing bars can be a core of continuous glass strand rovings wrapped with continuous strand glass mat.
5. The bearing bars can be joined into panels by passing continuous length fiberglass pultruded cross-rods through the web of each bearing bar.
6. A continuous fiberglass pultruded bar shaped section can be wedged between the two cross rod spacers mechanically locking the notches in the cross rod spacers to the web of the bearing bars.
7. Continuous chemical bonding can be achieved between the cross rod spacers and the bearing web and between the bar-shaped wedge and the two cross rod spacers, locking the entire panel together to give a panel that resists twist and prevents internal movement of the bearing bars.

8. After fabrication, all cut ends, holes, and abrasions of FRP shapes can be sealed with a compatible resin coating.

An example of a technical specification for pultruded FRP might be:

1. Manufacture: Grating components can be manufactured by the pultrusion process, can be of high strength and high stiffness elements having a maximum of 70% and a minimum of 65% glass content (by weight) of continuous roving and continuous strand mat fiberglass reinforcements. The finished surface of the product can be provided with a surfacing veil to provide a resin rich surface which improves corrosion resistance and resistance to ultraviolet degradation.

2. Grating bearing bars can be joined into panels, interlocked and epoxied into the proper spacing by passing a continuous, notched cross rod or cross rods through the web of each bearing bar. The notches can be spaced on centers to match the distance between the load bars. A continuous keeper can be driven behind the notched cross rod to affix it into place. Chemical bonding can complete the assembly of the cross bar system to ensure both a mechanical and chemical lock.

3. Non-slip surfacing: Grating can be provided with a grit bonded to the top surface of the finished grating product.

4. Color: Gray or Yellow.

5. Some alternative grating configuration include: 1" deep I- or T-Shaped section; 1½" deep I- or T-shaped section; or 2" deep I- or T-shaped section.

Some useful terms used in the manufacturing of molded FRP grating include the following:

Piece: The finished product, which the process produces.

Plug: The actual item to be duplicated in fiberglass or other composite materials, which is used to construct the mold. The plug can be the actual part or a custom-fabricated shape, made from virtually any type of material.

Mold: The item from which the piece will be made. There are two main types of molds, male and female. A male mold is identical to the item being duplicated, and the piece is made over the mold. A female, or cavity, mold is the reverse of the item to be duplicated, and the piece is made inside the mold. The word can also be used to describe the composite fabrication process: Molding a part.

Laminate: A solid part constructed from a combination of resin and reinforcing fabric. This term can also be used to describe the process of laying up a part: Laminating a part.

Gel Coat (or Surface Coat): The term gel coat is often used generically to describe any resin-based surface coating, but the term technically applies to polyester-based materials. The term surface coat can be used to describe either epoxy or polyester materials. Surface coats are specially formulated, thickened versions of resins which can be applied to the surface of a mold or piece to serve as a cosmetic and protective coating.

Release Agent Any of a number of materials applied to the mold surface before part fabrication, in order to aid in the release of the piece from the mold. These could be waxes, oils or specialty release coatings such as PVA.

Flange/Parting Dam: A temporary fixture attached to the plug when building multiple-piece molds. This generally creates a surface for materials to be molded against, perpendicular to the parting plane of symmetry. The flange aids in clamping or bolting the mold sections together, as well as serving as a mounting point during vacuum bagging operations.

Figure 4:
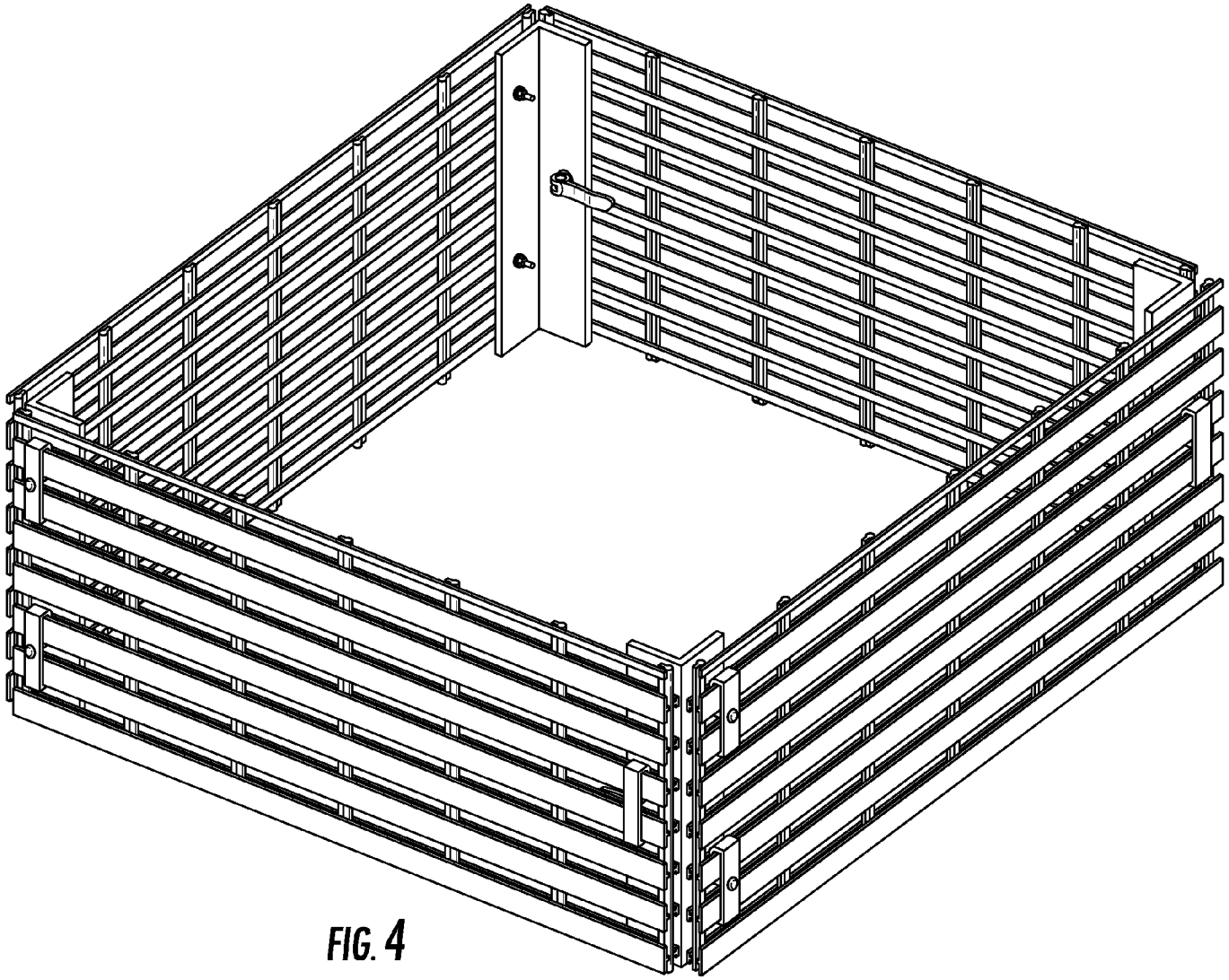
FIG. 4 shows a top perspective view of the product with T-bar grating.

FIG. 4 shows a top perspective view of a specific implementation of the product with T-bar grating construction. T-bar grating is used for the construction of the product. T-bars provide a greater grate surface area and less open space between bars. The increased grate surface area can enhance stiffness, increase load capacity, and the rebound characteristics of the wall.

Figure 5:
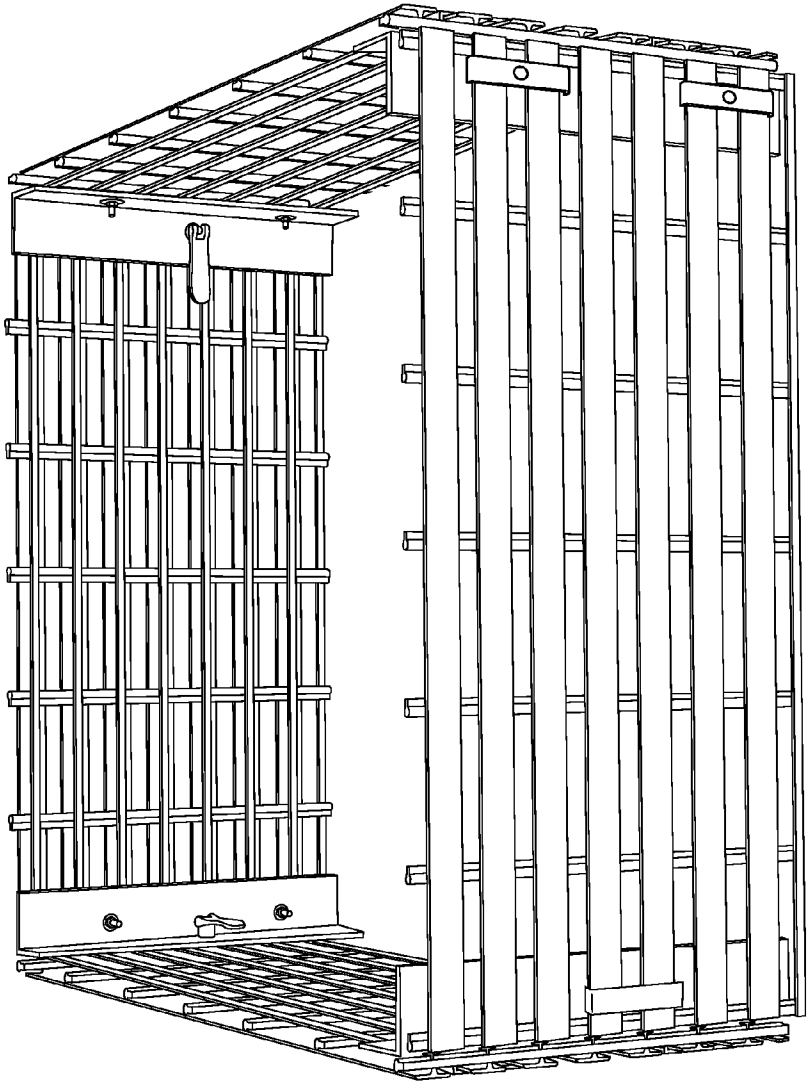
FIG. 5 shows a bottom perspective view of the product with T-bar grating.

FIG. 5 shows a bottom perspective view of a specific implementation of the product with T-bar grating. I-bar or other cross-section shaped bars can also be used to achieve similar characteristics. T-bar can mean pultruded grating of any cross sectional shape and depth. Load bearing cross bars (or rods) are positioned perpendicular to the load bearing T-bars to increase the strength of the grating, prevent twisting of the panel, and to distribute concentrated loads to adjacent bars. The dimensions of the bars, including the width of the T-bar top, open space between bars, grating height and thickness can be adjusted, depending on the application. For example, the T-bars can be positioned close together, with less open space between the bars, in order to decrease the open area between bars, and to increase the strength of the panel grating. The depth of the T-bar can be increased while using a greater open space between bars. This can also achieve similar performance characteristics.

In a specific implementation, there are approximately 6-10 bars per foot of width with about 15-60 percent of open space, depending on the type of bar (e.g., T-bar, I-bar, or a combination) used and the depth of the bar.

In a specific implementation, the grating includes pultruded fiberglass T-bar grating. In other implementations, various other manufacturing methods can be used for the grating.

Figure 6:
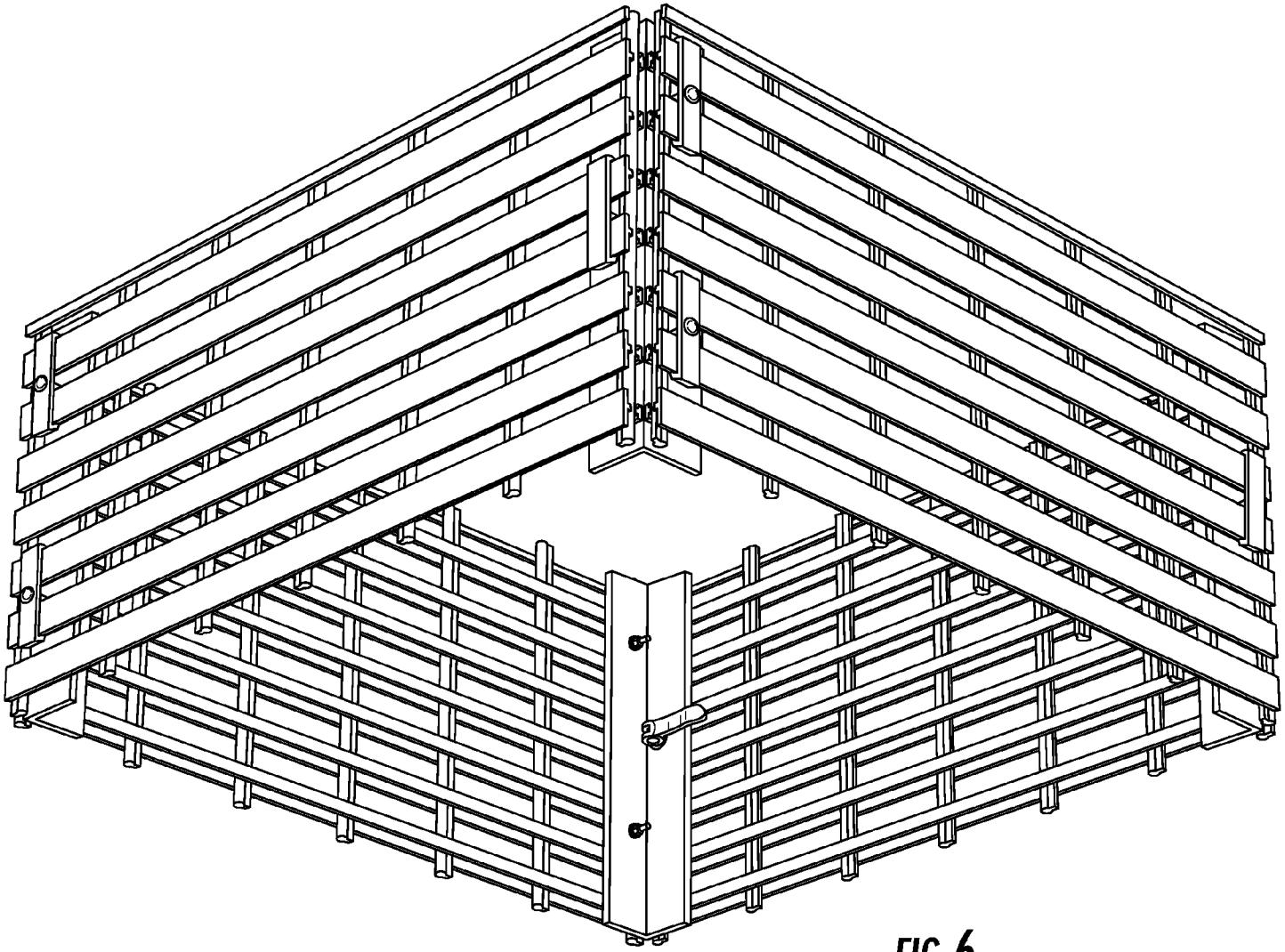
FIG. 6 shows another bottom perspective view of the product with T-bar grating.

Connection of the walls involves the use of fasteners and connectors that hold the walls tightly together. FIG. 6 shows a bottom perspective view of a specific implementation of the product where panels of grating are joined together by fasteners. In a specific implementation, panels of T-bar grating are connected together via a cross shaped corner bracket (or brace). The bracket connects two panels together to form a 90 degree corner. The bracket can be made from various materials including FRP, aluminum, steel, and others.

Figure 7:
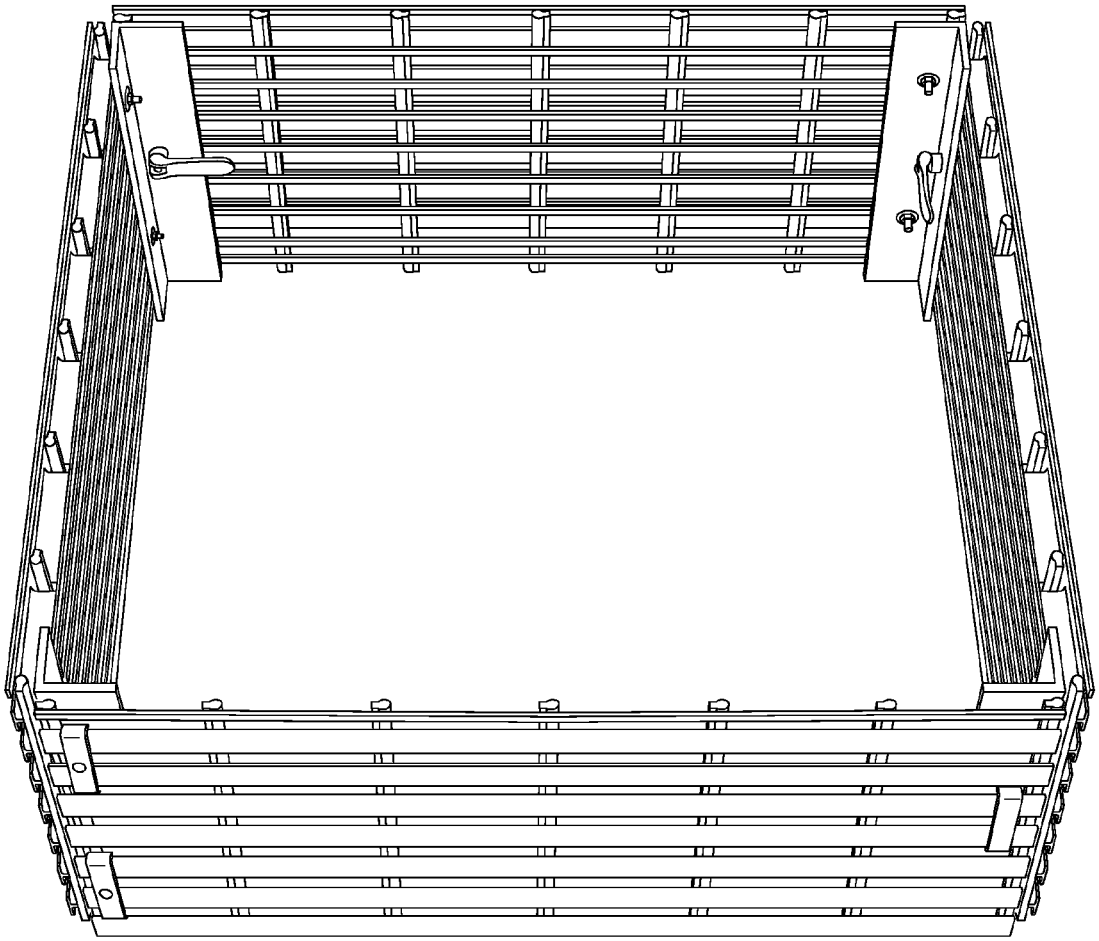
FIG. 7 shows another top perspective view of the product with T-bar grating.

FIG. 7 shows a box configuration having four panels joined together. For a box configuration, at least four brackets are used to join together four panels of grating. In other implementations, the product walls are of different dimensions from each other, and can be joined to form various other shapes (e.g., rectangle, pentagon, hexagon, or octagon).

Figure 8:
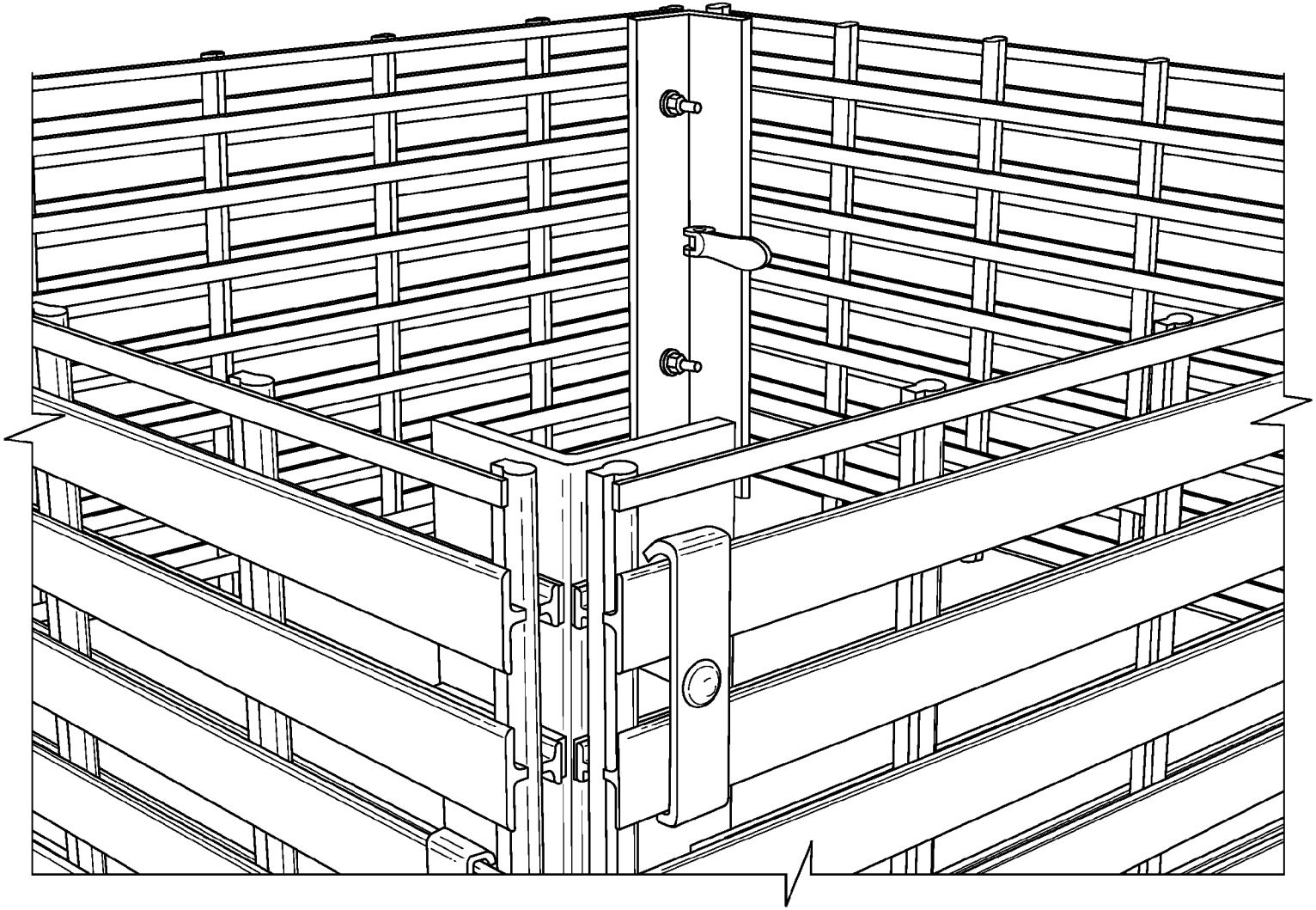
FIG. 8 shows two panels of grating joined together.
Figure 9:
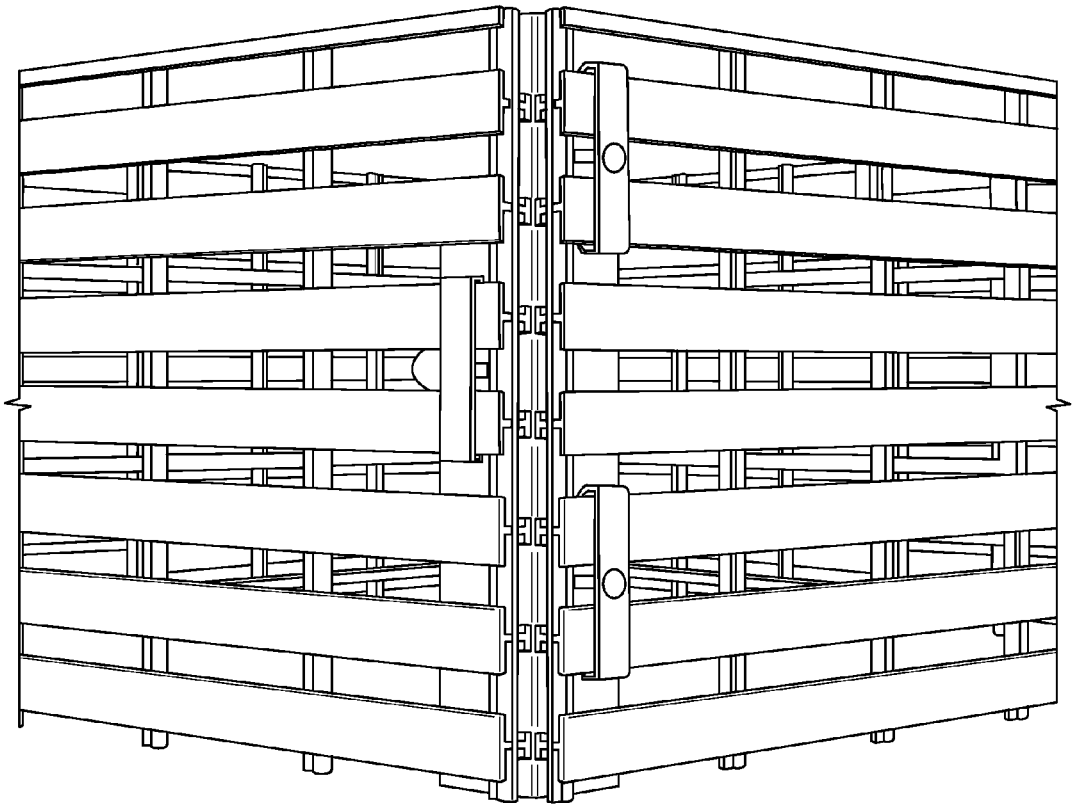
FIG. 9 shows a specific embodiment of fastening mechanisms used to join two panels of grating together.

FIG. 8 shows a specific implementation where a single corner bracket connects two panels together. The corner bracket has a length that is the same as the height of the box, as shown in FIG. 9, and extends in a direction that is perpendicular to the direction of the T-bars of the grating. The corner bracket distributes the clamping forces across a vertical face of the panel. In other implementations, more than one bracket can be used to connect two panels (e.g., two, three, or four).

The ends of the T-bars can be coupled to the bracket by screws and other fasteners. FIGS. 8 and 9 show a specific implementation using metal bars and angles along to attach the panels together. In other instances bar grating (or anchoring) clips and fasteners can be used to fasten the bar to the bracket. The clips can be installed on the top surface of the grating, and clip over a flange of the bar. The clips can have holes to receive a bolt that fastens the bar to the bracket. Various types of grating clips can be used, depending on the size and shape of the bars. Types of clips can include saddle clips, G-clips, paw clips, M-clips, F-clips, and many others. The clips can be of various lengths, with one or more multiple fasteners connected to each clip.

Figure 10:
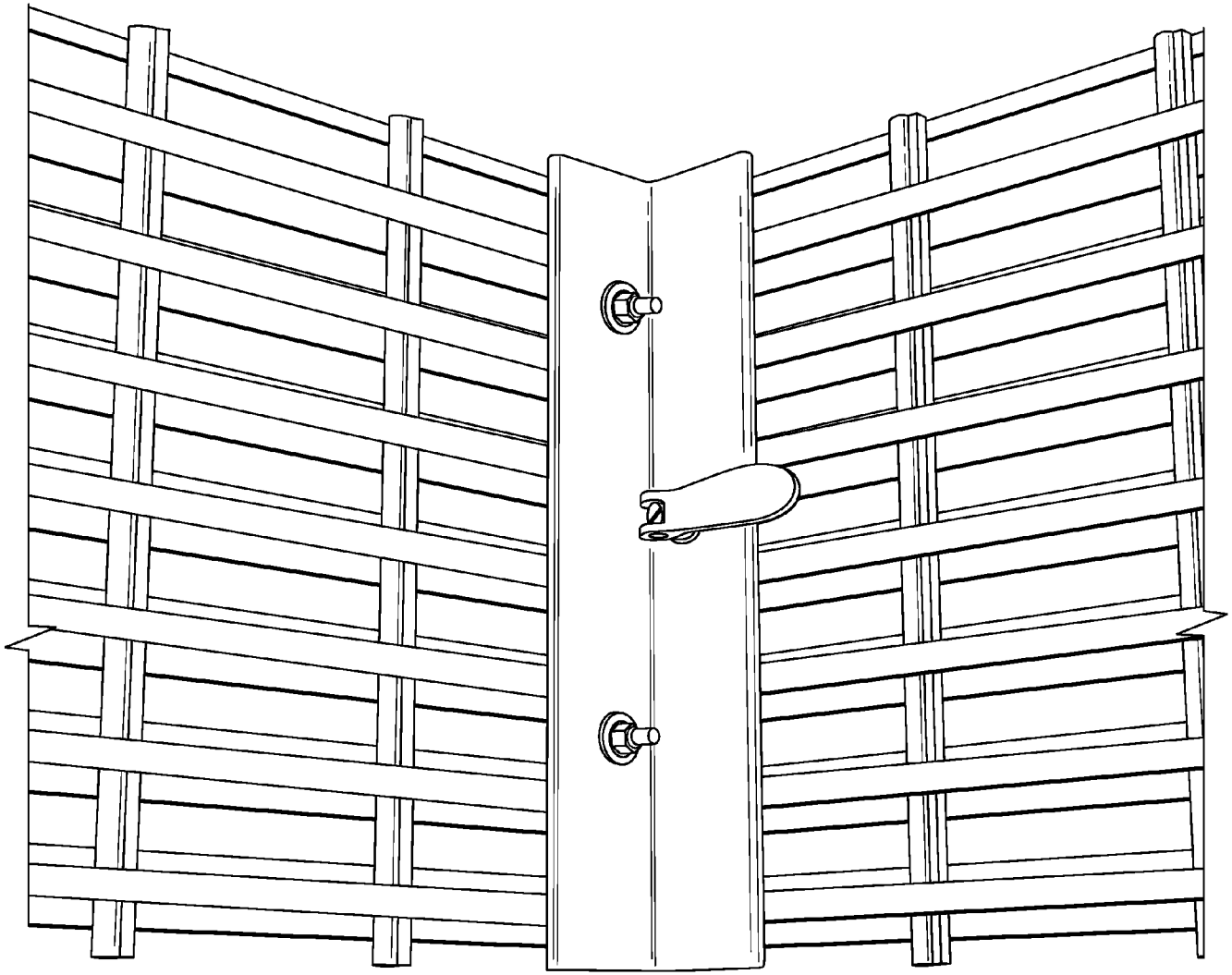
FIG. 10 shows a handle assembly of the product.

Handles, knobs, cam levers, and other fittings can be used to join the ends of the grating panels together. By constructing the wall joints with handle assemblies (or knob, nut, and bolt assemblies), the walls can be easily assembled and disassembled. FIG. 10 shows a specific implementation of a cam lever handle assembly. The cam lever is used to connect one panel of grating to the supporting angle. The handle portion is turned (opened, twisted, or pulled) to release the connection, to disassemble the two panels.

Figure 11:
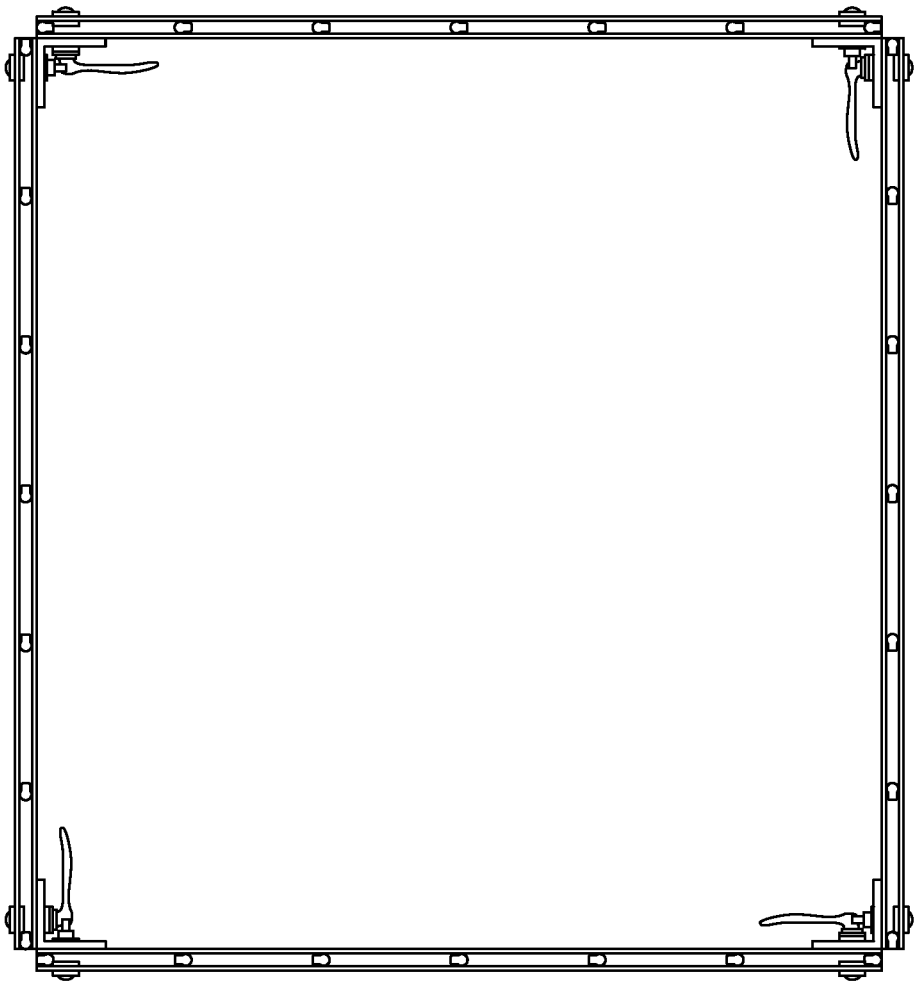
FIG. 11 shows a top view of the product.

FIG. 11 shows a specific implementation of a box configuration with four panels joined together, where at least four cam levers are used (e.g., at least one handle for each of the four corners). The box can be disassembled via the cam levers. The disassembled parts include four identically shaped panels, each including the individual panel and the angle bracket.

FIGS. 12A-13C show specific implementations of pultruded fiberglass reinforced T-bar grating panels having various dimensions.

Figures 12A, 12B, 12C:
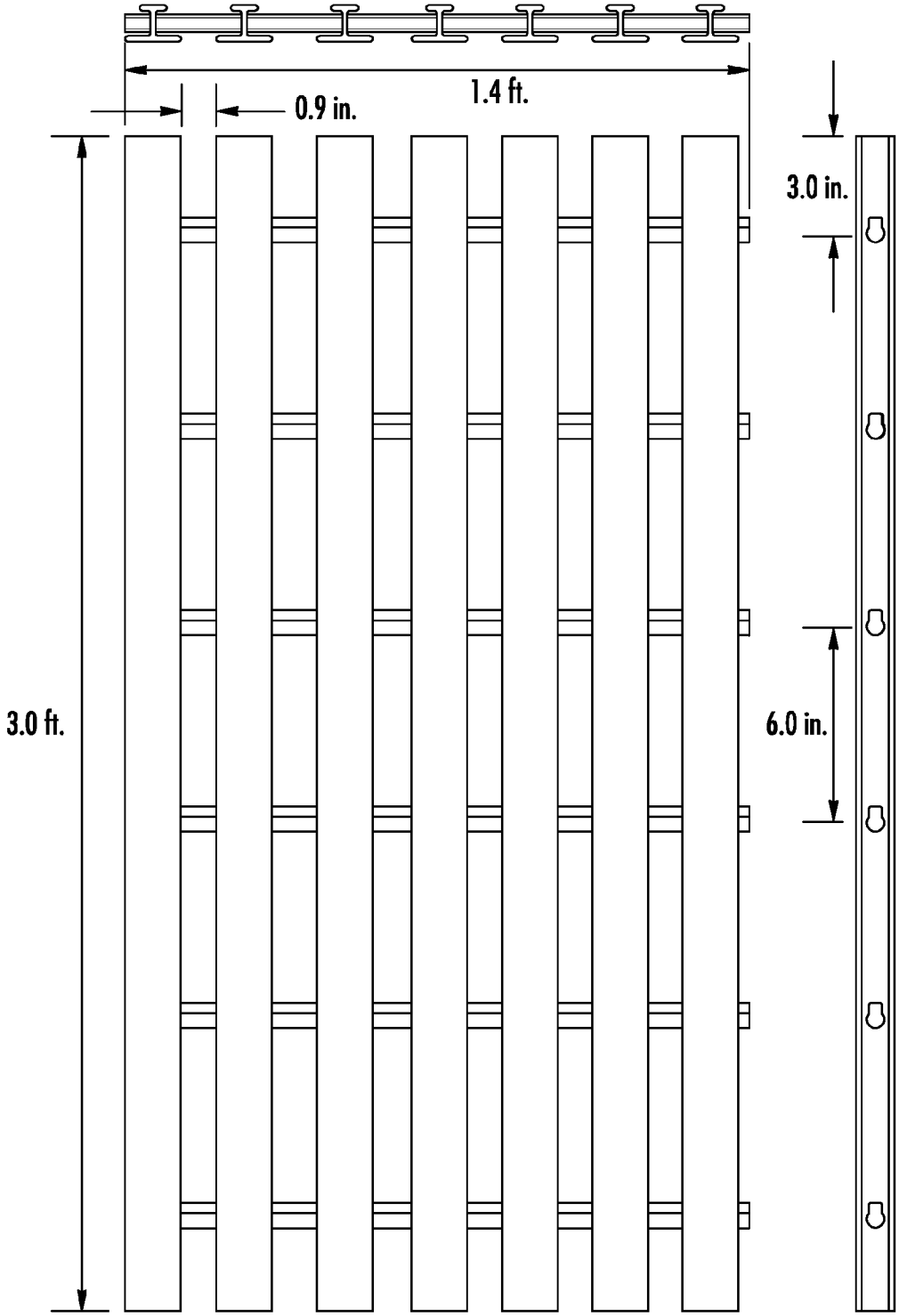
FIGS. 12A-12C shows a specific embodiment using a T-bar grating panel.

FIGS. 12A-12C shows a T-bar panel with about 0.9 inch spacing between each bar. In this embodiment, a width of the panel is about 1.4 feet, and a length is about 3 feet. Cross bars are arranged perpendicular to the load bearing T-bars, with about a 6 inch spacing between cross bars. A depth of the T-bar is about 0.5-2 inches.

Figures 13A, 13B, 13C:
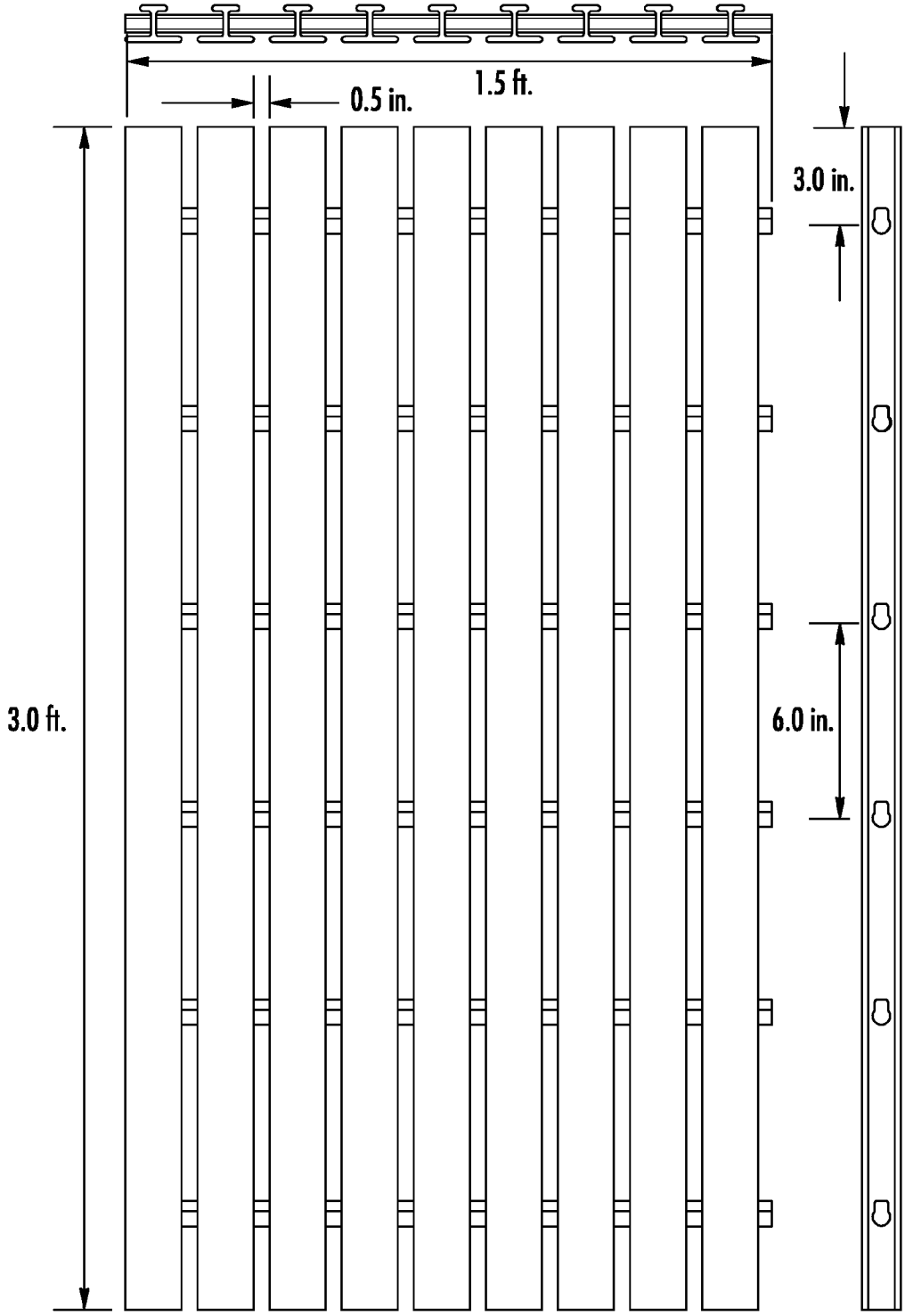
FIGS. 13A-13C shows another specific embodiment using a T-bar grating panel.

FIGS. 13A-13C shows another embodiment of a T-bar panel. The spacing between each T-bar is about 0.5 inch. A width of the panel is about 1.5 feet, and a length is about 3 feet. The cross bars are spaced around 6 inches apart. This configuration leaves less open space between bars that the configuration shown in FIGS. 12A-12C.

The invention is not limited to the specific dimensions presented. A panel may have additional reinforcements (not necessarily described in this application), or different types of grating which replace some of the types presented. The type of grating, and dimensions, in other implementations of the invention may be altered as appropriate for a particular application or based on the situation.

The manufacturing process for the product consists of relying on conventional technologies of making FRP grating and plate panels along with standard connections and fittings that, when assembled in the manner discussed herein, provides the desired characteristics for use as a soccer rebounding wall. There are two general methods that the product can be manufactured: (1) mold necessary fittings and connectors into the product during the molding process such that upon removing a panel from the mold all the necessary fittings are in place ("molded-in fittings"), (2) direct installation of fittings into standard FRP grating, or (3) a combination of both methods.

Molded-In Fittings. When constructed using fittings that are molded into the product, all of the necessary fittings are placed into the mold and the FRP is placed around the fittings such that the fittings are an integral part of the matrix of the plastic and do not require additional construction to make the product functional. The fittings that cannot be molded into the plastic include (1) the threaded knobs and (2) the gasket material, which must be installed after the FRP has cured.

Direct Installation of Fittings. Another method of fabrication of the product is to utilize raw FRP materials consisting of grating and cover plate and drill necessary holes into the grating to place the necessary fittings, including items such as spring dowels, threaded inserts and gasket, into the grating to create the final product.

Combination of Molded and Direct Installation of Fittings. A combination of molded-in and direct installation combination of the construction could include molding in to the grating the threaded insert, which is the primary load-bearing fitting, and drilling necessary holes into the grating to place the necessary fittings, including items such as spring dowels and gasket, into the grating to create the final product.

Other Fittings and Appurtenances. The other fittings and appurtenances that must be made in order to assemble a final product include (1) the threaded stud knobs and (2) gasket material placed at the location of intersecting wall panels.

The threaded stud knobs can be manufactured in two primary manners, including (1) molding the threaded studs directly into the plastic knob or (2) screwing threaded studs into a female knob and using thread fastener, such as manufactured by Loctite, to prevent the unscrewing of the threaded stud.

Aspect Ratio. For a composite, it refers to the specific ratio of the fiber or filler in the composite matrix.

Composite. A combination of one or more materials differing in form or composition on a macroscale. The constituents retain their identities; i.e. they do not dissolve or merge completely into one another, although they act in concert. Normally, the components can be physically identified and exhibit an interface between one another.

Phenolic Resins. Phenolic composites have many desirable performance qualities including high temperature resistance, creep resistance, excellent thermal insulation and sound damping properties, corrosion resistance and excellent fire/smoke/smoke toxicity properties.

Polyester Resins. Considered the "workhorse" of the composites industry, these resins offer a balance of properties (including mechanical, chemical, electrical) dimensional stability, cost and ease of handling or processing. Polyesters are versatile because of their ability to be modified or tailored. Ortho- and Iso-Polysters are two types of polyester resins formulated to enhance corrosion resistance.

Thermoplastic. Resin that is not cross-linked. Thermoplastic resin generally can be re-melted and recycled.

Thermoset. Resin that is formed by cross-linking polymer chains. A thermoset cannot be melted and recycled because the polymer chains form a three dimensional network.

Vinyl Ester Resins. Vinyl esters offer mechanical toughness and excellent corrosion resistance.

The product has highly preferential elasticity characteristics. Elasticity implies that deformations produced by low stress are completely recoverable after loads are removed. The Modulus of Elasticity ("E") is a measurement of the ratio of stress placed upon a material compared to the strain (deformation) that the beam exhibits along its length. The greater the E value, the stiffer the material and the less deformation that will occur for an equivalent loading to an equivalent structural member. The three moduli of elasticity, which are denoted by $E_L$, $E_R$, and $E_T$, respectively, are the elastic moduli along the longitudinal, radial, and tangential axes.

For example, the modulus of elasticity for wood is not suitable. Because wood is an anisotropic material, the E value will differ depending upon the direction of the applied force with respect to the material's structure. Typical wood beams are loaded in the longitudinal direction, therefore, $E_L$ is the appropriate value for structural design. If the product's panels were made using wood, they would be made using wide face of the wood as the contact surface of the panel. In this configuration, the appropriate E value for comparison to other materials would be $E_T$. The $E_T/E_L$ or $E_R/E_L$ ratios for pine and fir trees range between 4 percent and 13 percent, i.e., the elasticity of wood in the direction used for the panel is 4 percent to 13 percent of that if the same wood were used as a beam with the loading perpendicular to the width of the wood.

In this patent, the symbol A denotes a superscript. For example, x^2 corresponds to x-squared or ($x^2$) or "x.sup.2".

The EL values for various pine and fir softwoods vary from 1.1×10^-6 to 1.9×10^-6 pounds per square inch ("psi") or ($1.1\times10^{-6}$ to $1.9\times10^{-6}$ psi) or "1.1.times.10.sup" adj "6". When adjusted for the loading that would be applied based upon the use of wood for the panels, the actual E values, using the larger values within the ranges (i.e., 13 percent of an E value of 1.9×10^-6 psi) or ($1.9\times10^{-6}$ psi) would be approximately 2.5×10^-7 psi or ($2.5\times10^{-7}$ psi) or "2.5.times.10.sup" adj "7".

The modulus of elasticity for fiber-reinforced plastic is much more suitable for the purposes as described above. FRP is also an anisotropic material. The modulus of elasticity for FRP coupons is approximately 2.8×10^-6 psi or ($2.8\times10^{-6}$ psi) or "2.8.times.10.sup" adj "6". Similar to wood, E values will vary depending on the axis against which loading is placed. If the panels were made from FRP, the contact surface would be along the stronger axis for the material (i.e., causes deformation in the primary design axis). For E values measured along the grain of the FRP, E values can range from 5.8×10^-6 to 6.5×10^-6 psi or $5.8\times10^{-6}$ to $6.5\times10^{-6}$ psi or "5.8.times.10.sup" adj "6" to "6.5.times.10.sup" adj "6". Therefore, compared to wood, pultruded FRP panels have approximately one tenth the deflection for an equivalent loading.

Other materials, such as aluminum and steel, both have greater E values than either wood or FRP. The typical E value for aluminum is 10×10^-6 psi or "10.times.10.sup" adj "6" or $10\times10^{-6}$ psi while steel has E values of 29×10^-6 psi or "29.times.10.sup." adj "6" or $29\times10^{-6}$ psi. Wood, FRP, aluminum and steel have the following densities and E values. The elasticity of other materials is given in the following table.

TABLE 2

Elasticity of Various Materials

| Material | Density (lbs/ft^3) | Modulus of Elasticity (×10^-6) | Ratio of Density to Modulus of Elasticity |
|---|---|---|---|
| FRP Coupons | 100 to 112 | 2.8 | 6 × 10^-8 |
| Wood (Douglass Fir) | 27 to 32 | 0.25 | 8 × 10^-9 |
| Aluminum | 167 | 10 | 6 × 10^-8 |
| Steel | 484 to 503 | 30 | 6 × 10^-8 |

Although the density of wood is much less than that of FRP, aluminum, and steel (and therefore lighter), the ratio of the density to the E value indicates that approximately 7 to 8 times the mass of wood would be necessary to equal the deflection characteristics of the other materials. FRP, however, has a density to E ratio comparable to that of aluminum and steel, yet has a 33 percent lower density than aluminum and a 77 percent lower density than steel. As a result, comparable strengths can be achieved with less weight by using FRP panels. However, aluminum could also be used while still maintaining a relatively lightweight when compared to steel.

The product also performs better under point loads than other systems. In the science of materials, numbers that quantify the response of a particular material to elastic or non-elastic deformation when a stress load is applied to that material are known as Elastic Constants. They are the relationships that determine the deformations produced by a given stress system acting on a particular material, and within the limits for which Hooke's Law of Elasticity is obeyed, these factors are constant: The Modulus of Elasticity, E; The Modulus of Rigidity, C; The Bulk Modulus, K; Poisson's Ratio 1/M or σ.

Hooke's Law of Elasticity is an approximation that states that the extension of a spring is in direct proportion with the load applied to it. Many materials obey this law as long as the load does not exceed the material's elastic limit.

Figure 14:
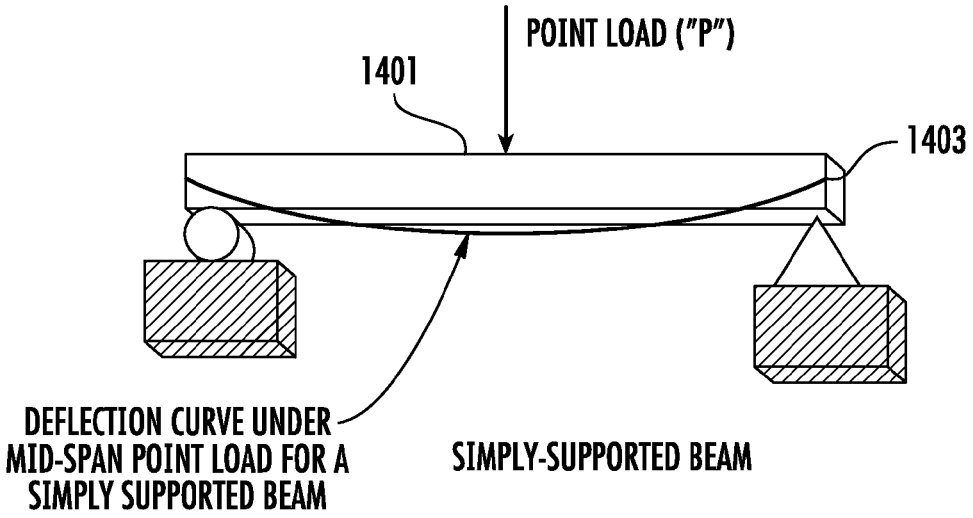
FIG. 14 shows an example of a simply supported beam.

An example is for the simply supported beam. A simply supported beam is one where the beam is free to bend and rotate at both sides. FIG. 14 shows an example of a simply supported beam. Location 1401, or P, is the point load applied at the mid-span of the beam. The cylinder support allows the beam to rotate and move laterally while the triangular support fixes the beam laterally but allows the beam to rotate. As a result, deflection of the beam is a simple curve as shown by line 1403.

Figure 15:
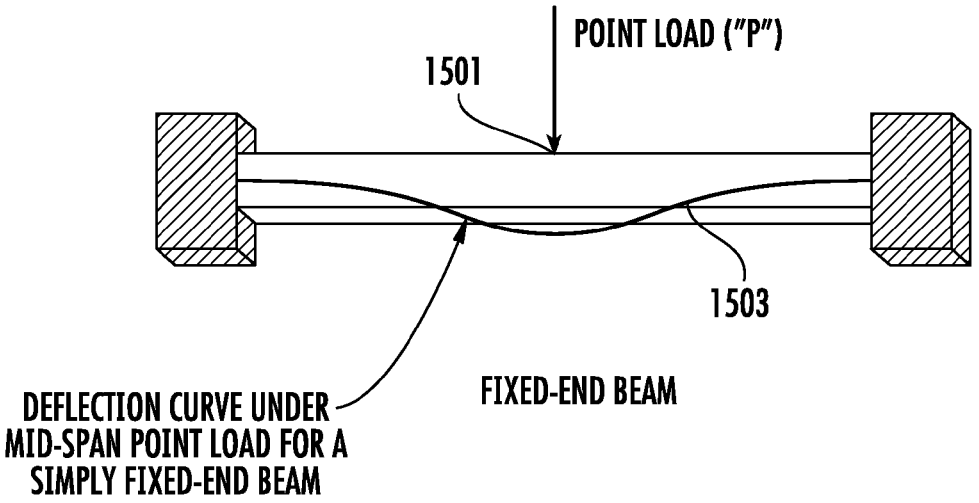
FIG. 15 shows an example of a fixed end beam.

A fixed-end support beam is one where both sides of the beam are prevented from moving or rotating and therefore there is no deflection at the ends. FIG. 15 shows an example of a fixed end beam. In a fixed-end beam, the deflection curve has inflection points on both sides of a point load 1501 as shown in deflection curve 1503.

Figure 16:
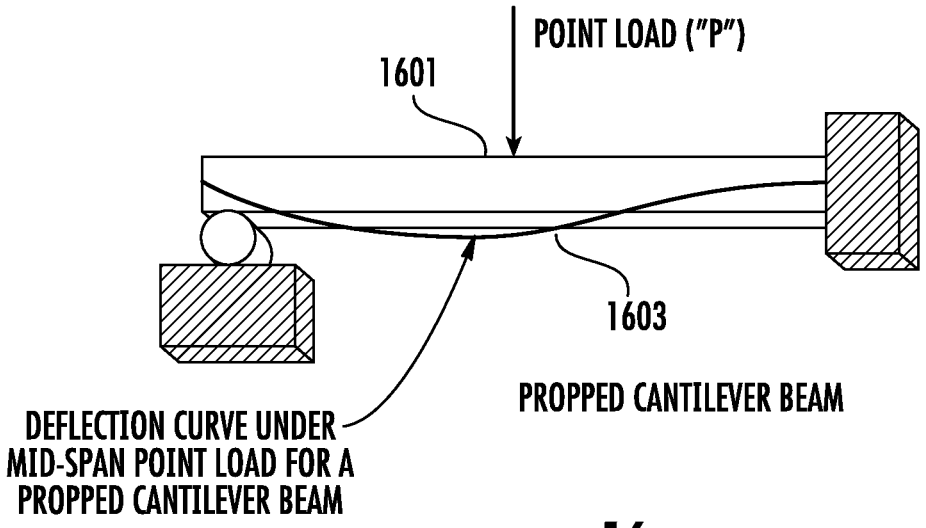
FIG. 16 shows an example of a propped cantilever beam.

Another example is the propped cantilever beam. With a propped cantilever beam, one side of the beam is free to rotate and move laterally while the other end is fixed and cannot rotate or move laterally. FIG. 16 shows an example of a propped cantilever beam. With a propped cantilever beam for a point load 1601, a deflection curve 1603 is similar to a combination of both simply supported and fixed-end beams and has only one inflection point on the fixed-end side of the beam.

Depending upon the configuration of the panel, each panel may behave more or less like one of the three beams discussed above. From the perspective of beam deflection theory, the pultruded FRP panel load bars are essentially individual beams with both ends of the load bars fixed to the supporting bracket. This load bar configuration is the equivalent of a fixed-end beam. Additionally, when the individual load bar is under deflection, the cross braces in the FRP panel serve to transfer some load from one load bar to the adjacent load bars, which will absorb some of the impact and helps prevent rotation of the individual load bars.

In a pultruded FRP panel, if a load bar were attached to the support bracket at one end and resting freely on the opposite side, it's structural behavior would be more similar to that of a propped cantilever beam than to that of a fixed-end beam.

From the perspective of beam deflection theory, molded panels will behave somewhat differently than pultruded panels because of the interconnectivity of the fiberglass molding. Given the number of interconnecting bars, molded panels can also behave isotropically. A molded panel with a FRP plate bonded to the face of the panel can add stiffness and increase the isotropic behavior of the molded FRP panel.

The molded panel itself functions as one single, wide beam because of the number of cross-connection in the panel. As a result, a molded panel can behave as either a single fixed-end or propped cantilever beam depending upon how it is fixed at each end.

From the perspective of beam deflection theory, extruded aluminum panels are configured in much the same way as pultruded FRP panels in that they consist of a series of load bars with cross bars joining each load bar. Beam deflection for aluminum panels would be similar to that of pultruded FRP panels in that they would behave as a fixed-end beam when attached to the support brackets at each end.

Similar to pultruded FRP panels, if bearing bar in an aluminum panel were only attached to the support bracket at one end, it's structural behavior would be more similar to that of a propped cantilever beam than to that of a fixed-end beam.

For the theoretical panel deflection under point loading, the maximum deflection for each type of beam identified above is calculated as follows (P being the applied load; L being the length of the panel; E being the Modulus of Elasticity; and I being the Moment of Inertia):

Fixed-End Deflection: Equation 1

$$\frac{PL^3}{192EI}$$

Propped, Cantilever Beam Deflection: Equation 2

$$\frac{7PL^3}{768EI}$$

Simply Supported Beam Deflection: Equation 3

$$\frac{PL^3}{48EI}$$

The Moment of Inertia is a property of a beam cross-section that can be used to predict the resistance of a beam to bending and deflection around an axis that lies in the cross-sectional plane. The stress in, and deflection of, a beam under load depends not only on the load but also on the geometry of the beam's cross-section; larger values of Moment of Inertia cause smaller values of stress and deflection. When comparing the deflection characteristics of the same beam under different loading conditions the Moment of Inertia is constant.

Figure 17:
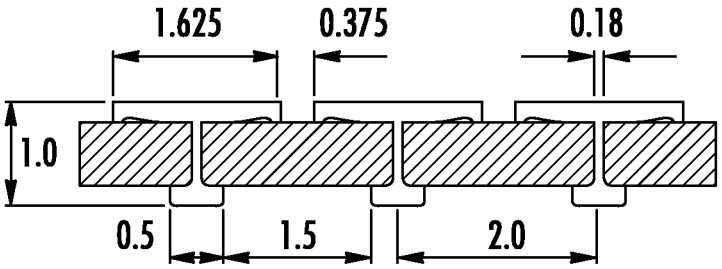
FIG. 17 shows sample moment of inertia for a T-shaped cross section in a first configuration.

Based upon the above, the deflection at the center of the for a fixed-end beam is approximately 55 percent less than the deflection of a comparable, simply supported panel and almost 30 percent less when compared to a propped, cantilever panel. FIG. 17 shows sample moment of inertia for a T-shaped cross section in a first configuration. For example, the cross section in FIG. 17 has a Moment of Inertia of 0.306 inches.

Figure 18:
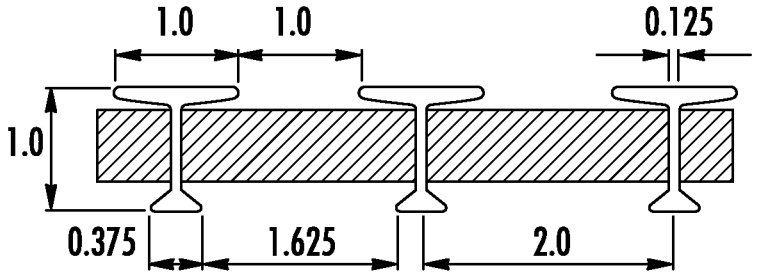
FIG. 18 shows sample moment of inertia for a T-shaped cross section in a second configuration.

FIG. 18 shows sample moment of inertia for a T-shaped cross section in a second configuration. However, the cross section in FIG. 18 below, has a Moment of Inertia of 0.197 inches. Therefore, the panel cross section in FIG. 17 would have a lesser deflection for the same configuration and point loading as the cross section in FIG. 18.

Figure 19:
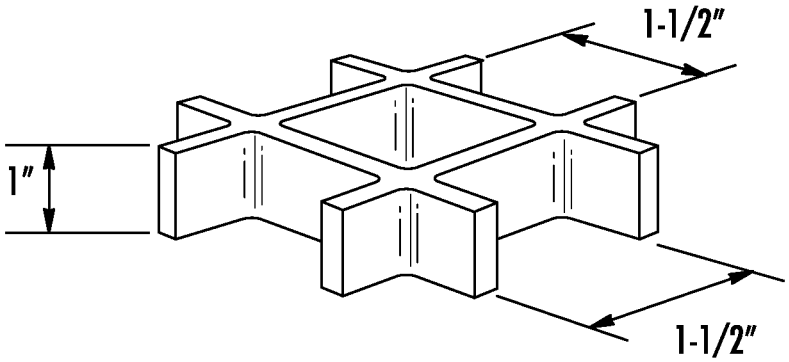
FIG. 19 shows sample moment of inertia for a square grating cross section.

FIG. 19 shows sample moment of inertia for a square grating cross section. The grating section drawing in FIG. 19 has a Moment of Inertia of 0.14 inch^4 per foot ("0.14 inch-.sup.4" per adj foot).

For square grating as shown in FIG. 19 with a ⅛ inch thick, bonded cover plate, the Moment of Inertia is approximately 35 percent greater than standard molded grating and would have a Moment of Inertia of 0.215 in^4/ft ("0.215 inch.sup.4" per adj foot). Therefore, as can be seen above, the cross section of the individual panels, which have Moments of Inertia ranging from 0.14 inch^4 per foot to 0.306 inches^4 per foot ("0.306 inches.sup.4" per adj foot), can change the maximum deflection by a factor of two times. Table 3 summarizes the discussion above and presents the estimated panel deflection for each type of panel based upon a single, mid-span point load of 200 pounds.

TABLE 3

Estimated Deflection for Various Beam Cross Sections and Materials

| Panel Type | I (inches^4/foot) | Weight (pounds/foot^2) | P (pounds) | E (pounds/in^2) | L (inches) | Deflection (inches) |
|---|---|---|---|---|---|---|
| Pultruded FRP (1) | 0.306 | 2.6 | 200 | 2.8E+06 | 36 | 0.06 |
| Pultruded FRP (2) | 0.197 | 1.6 | 200 | 2.8E+06 | 36 | 0.09 |
| Molded FRP | 0.14 | 2.6 | 200 | 2.8E+06 | 36 | 0.12 |
| Molded FRP with Plate | 0.214 | 3.1 | 200 | 2.8E+06 | 36 | 0.08 |
| Aluminum | 0.306 | 3.9 | 200 | 1.0E+07 | 36 | 0.03 |

Based upon the estimated deflections in table 3, aluminum would have half the deflection but 50 percent more weight than a comparable pultruded FRP panel.

The product has been designed with many new key features that improve upon prior art to allow for construction of a product that can achieve the desired performance characteristics. These new features include (1) the use of special, light-weight yet rigid materials of construction, (2) the use of special connections between panels to provide a structurally stiffener yet lightweight product, (3) the use of quick-connect fittings to greatly enhance speed and ease of assembly and disassembly, and (4) the complementary design of the above to result in a rigid, flexible, portable, and lightweight soccer rebounder.

Because the product uses a lightweight, stiff material that is configured in such a way to reduce deflection by fixing both ends of the load bars, the design takes advantage of several structural engineering concepts that minimize deflection of the panel, increase panel stiffness, and therefore improve the overall rebound characteristics of the soccer ball when compared to simply supported designs using materials of comparable weight.

Figure 20:
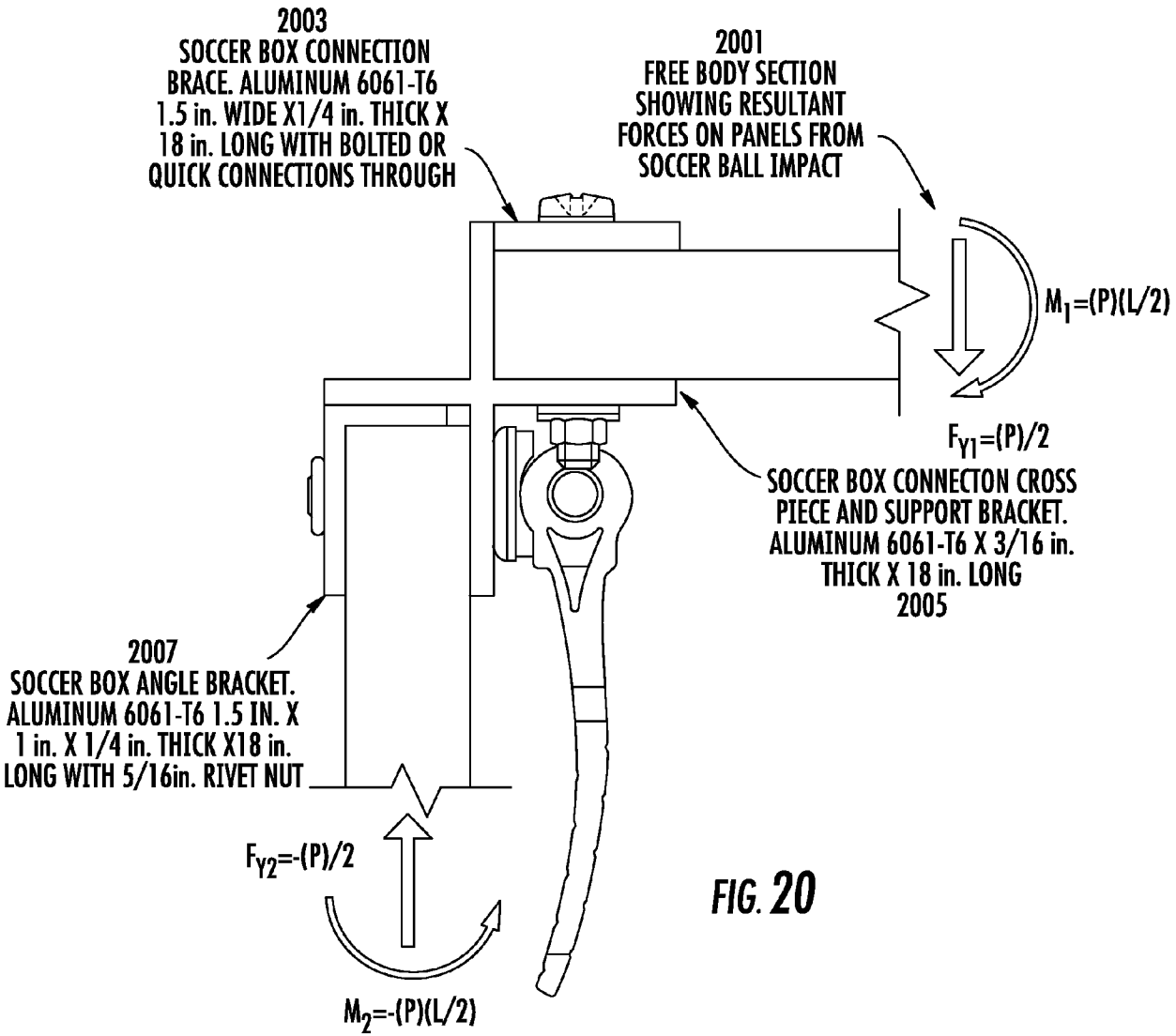
FIG. 20 shows a sample cross-shaped corner bracket.

FIG. 20 shows a sample cross-shaped corner bracket. The cross-shaped corner brackets provide several structural functions that benefit the product's rebounding performance. These X-corner (or cross) brackets:

i. Provide vertical support for each panel, ii. Connect the panels such that they behave as a fixed-end beam, which reduces the overall deflection and increases the rigidity of the panels, iii. Connect the panels with sufficient rigidity to the adjacent, perpendicular panel that much of the impact load from the soccer ball is transferred to the adjacent, perpendicular panel in the form of bending moment, iv. Transfers shear stress to the perpendicular and parallel panels, and v. Prevents rotational movement of any of the panels.

For example, the figure shows a free body section 2001 showing resultant forces on panels from impact (e.g., from a soccer ball). Item 2003 shows a connection brace. In an implementation, the brace is bolted through (or permanently affixed together). In another implementation, the brace is secured with a quick connection (or removably coupled together). Item 2005 shows a connection cross piece and support bracket. Item 2007 shows an angle bracket.

Figure 21:
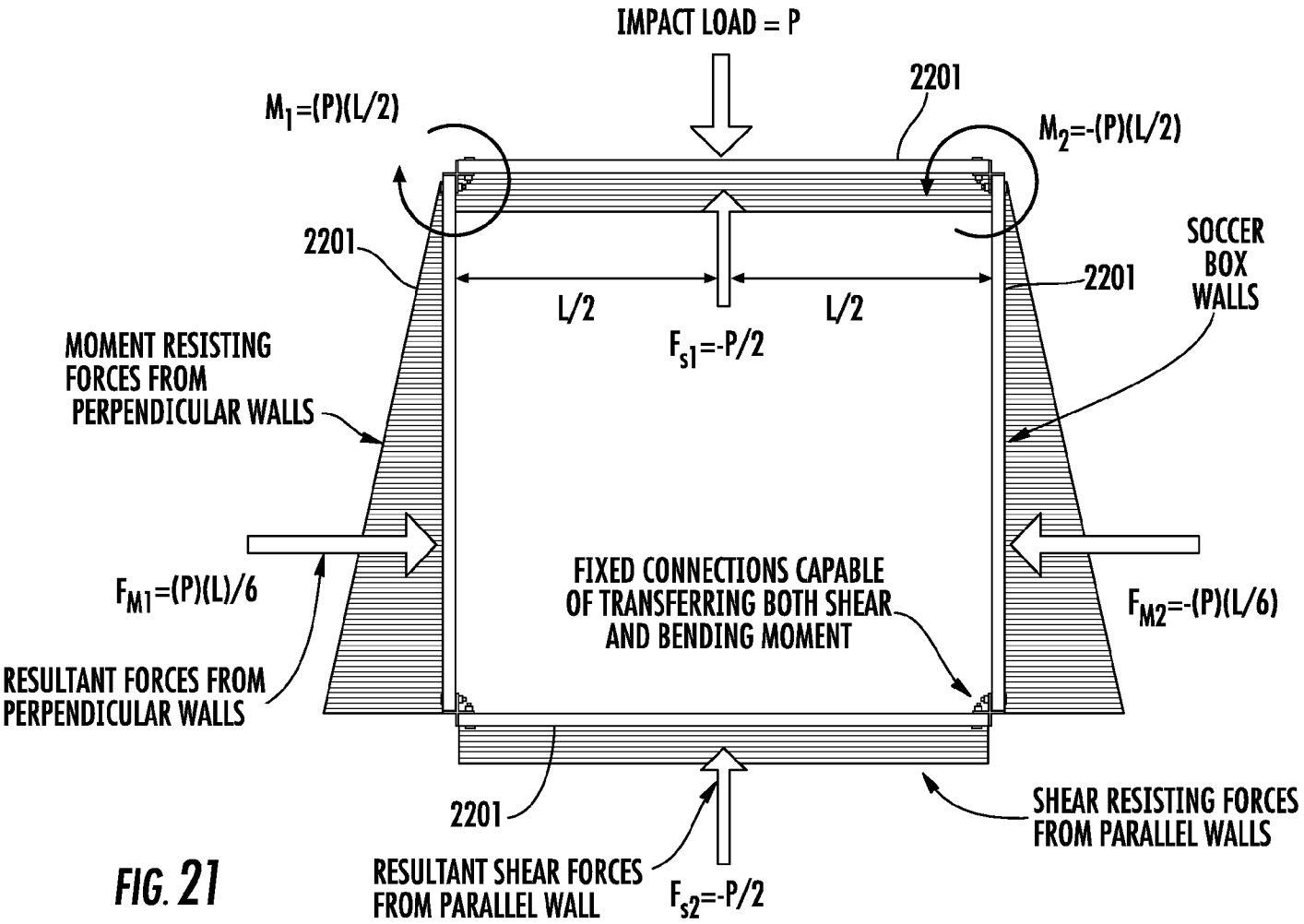
FIG. 21 shows connection of the perpendicular walls of the product.

FIG. 21 shows connection of the perpendicular walls of the product. The connection of the perpendicular walls 2201 of the product allows for the full transfer of shear and bending moment from the wall impacted by a soccer ball and the adjacent, perpendicular walls. This connection also creates the fixed-end beam behavior of each wall, as discussed above.

The box shape of the product also provides a material benefit to the performance of the product by allowing:

The adjacent, perpendicular walls assist to resist both bending moment and shear forces, The far, parallel wall assist in prevent tipping moment when the ball is struck above the center of gravity of the box, The far, parallel wall to assist in resisting ground shear that would cause the product to move upon impact with the soccer ball.

The following terms are used in FIG. 21:

P: Impact Loading from Soccer Ball $F_{S1}$ and $F_S$: Resultant Resisting Ground Shear from Soccer Ball Loading $M_1$ and $M_2$: Bending Moment Created from Soccer Ball Loading $F_{M1}$ and $F_{M2}$: Resultant Resisting Forces from Walls Perpendicular to Main Wall L: The Length of the Panel Wall.

Figure 22:
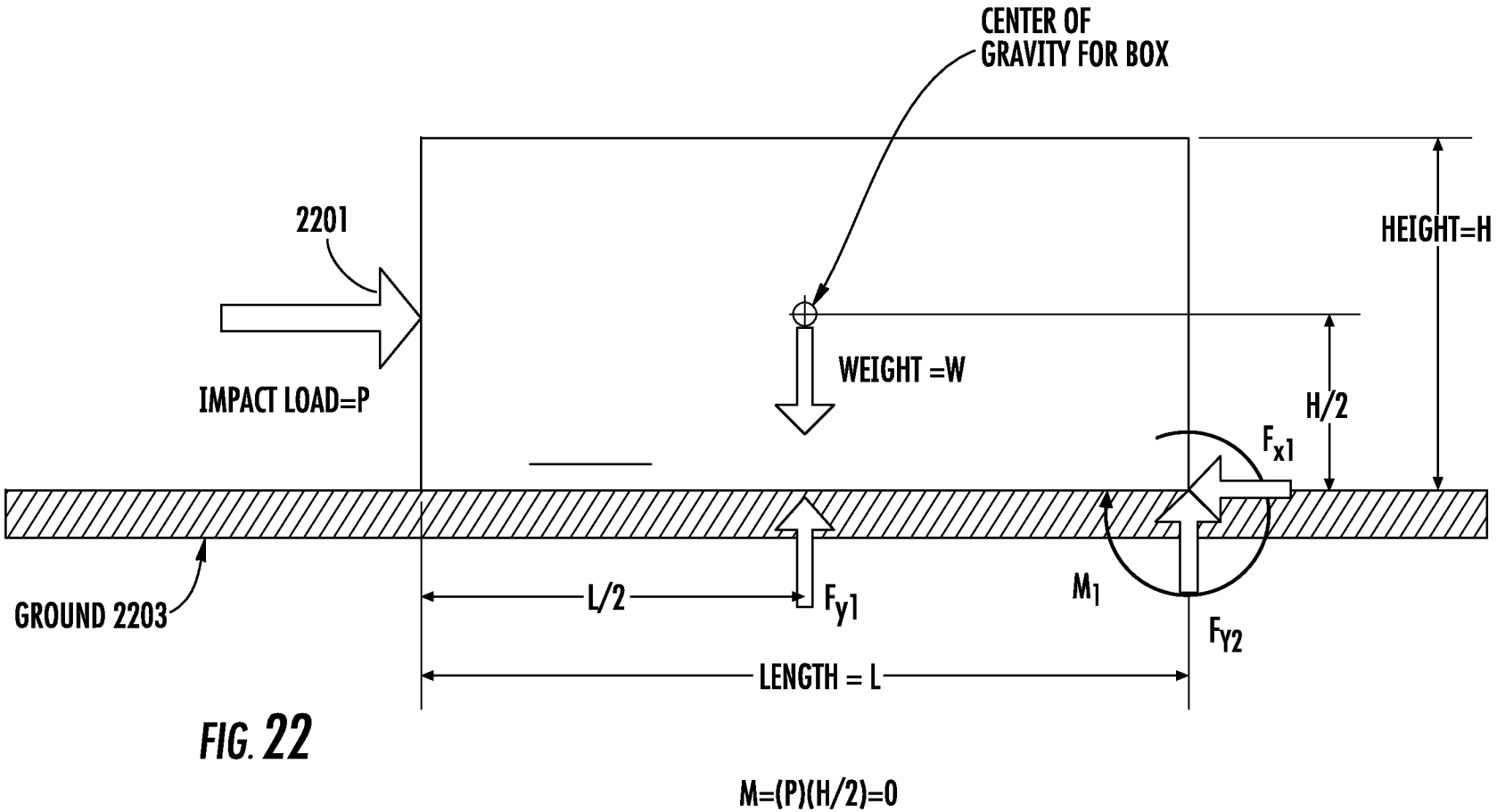
FIG. 22 shows a free body diagram of the product under impact loading in the vertical plane.

FIG. 22 shows a free body diagram of the product under impact loading in the vertical plane. This assumes the ball is hit at the center of gravity of the product 2201. Soccer balls hit below the center of gravity will not see any forces acting to tip the box over and will only result in shear forces along the ground 2203 resisting sliding. The following terms are associated with FIG. 22:

P: Impact Loading from Soccer Ball.

$F_{Y1}$ and $F_{Y2}$: Resultant Forces Resisting the Weight and Tipping Moment of the Soccer Ball Impact.

$F_{X1}$: Resultant Force Resisting Shear Created from Soccer Ball Impact.

$M_1$: Bending Moment Created from Soccer Ball Loading.

$F_{M1}$ and $F_{M2}$: Resultant Resisting Forces from Walls Perpendicular to Main Wall.

H: The Height of the Panel Wall.

Because the product is 18 inches high and the diameter of a Size 5 soccer ball is approximately 8.75 inches, the majority of the strikes against the product will occur at a height of below 5 inches (i.e., approximately half the diameter of the soccer ball) and will not generate tipping moment that would lift the front of the box from the ground. Additionally, the weight of the product is approximately 50 pounds To lift the front of the box from the ground, a ball struck perfectly at the top of the product would need to generate a force calculated as follows.

$$(P)(H) = \frac{(W)(L)}{2} \qquad \text{Equation 4}$$

Modified equation 4 — Equation 5

$$P = \frac{(W)(L)}{2(H)}$$

Because L=2(H), the force needed to just lift the front of a perfectly struck soccer ball would need to be 50 pounds. For a soccer ball struck three-quarters of the height of the product, the ball would need to generate a force calculated with the following equation.

$$(P)\left(\frac{H}{2}\right) = \frac{(W)(L)}{2} \qquad \text{Equation 6}$$

Modified equation 6 — Equation 7

$$P = \frac{(W)(L)}{H}$$

Because L=2(H), the force required to lift the front edge of the product from the ground would be 100 pounds in this example.

On a well-struck ball intended to travel 25 yards, an average youth soccer player may generate 600 pounds of force. This assumes a contact time of 0.05 seconds between the ball and the foot. However, the force imparted by the soccer ball against the panel is a function of the mass of the soccer ball and the rate of deceleration upon impact against the wall.

The Laws of the Game promulgated by FIFA, the international governing body of soccer, specify that the ball weigh between 14 and 16 ounces at the start of a match. The velocity of a ball kicked with 600 pounds force is approximately 14 meters/second. The force imparted by the ball on the panel is calculated by the following equation.

$$F = (M)\left(\frac{\Delta V}{\Delta t}\right) \qquad \text{Equation 8}$$

Where F is the force, M is the mass, ΔV is the change in velocity, and Δt is the change in time. However, because the deflection of various cross sections of pultruded FRP under different loads are available from manufacturers, it is possible to obtain the spring force constant (k) for each type of pultruded FRP section. For example, a pultruded FRP that deflects 0.12 inches under 200 pounds force has a spring constant as shown in the following equation.

$$k = \frac{F_x}{x_i - x_o} \qquad \text{Equation 9}$$

Where: $x_o$ is 0 (i.e., starting point prior to load), $x_i$ is 0.12 inches (0.03 m), and $F_X$=200 pounds or 28.5 lbs/bar (8.4 kg/bar). The calculated spring constant is k=280 kg/m. Therefore, the force on the panel is calculated using the following equation.

$$F = V\sqrt{\frac{kW}{g}} \quad \text{Equation 10}$$

Where: V is Velocity (m/s), W is Weight (kg), k is spring constant (kg/m), and g is gravitational constant (9.81 m/s$^2$). This results in the following equation.

$$F = 14\frac{m}{\sqrt{\frac{280\frac{kg}{m}(0.45kg)}{9.81\frac{m}{s^2}}}} \quad \text{Equation 11}$$

This is equivalent to 50 kilograms force or 110 pounds force. Given the spring constant, the FRP is able to reduce the overall force imparted on the wall by a factor of six when compared to the amount of force imparted on the ball to achieve the 14 meters per second velocity. It is this selection of materials that substantially improves on prior art to allow for the lightweight nature of the product with the appropriate rebound characteristics to occur. A stiffer product would have proportionally greater impact force from the ball.

Additionally, a ball struck in line or below the center of gravity of the box would not generate any tipping moment and therefore the box would remain generally stable (assuming the force did not exceed its shear resistance of the product along the ground).

Figure 23:
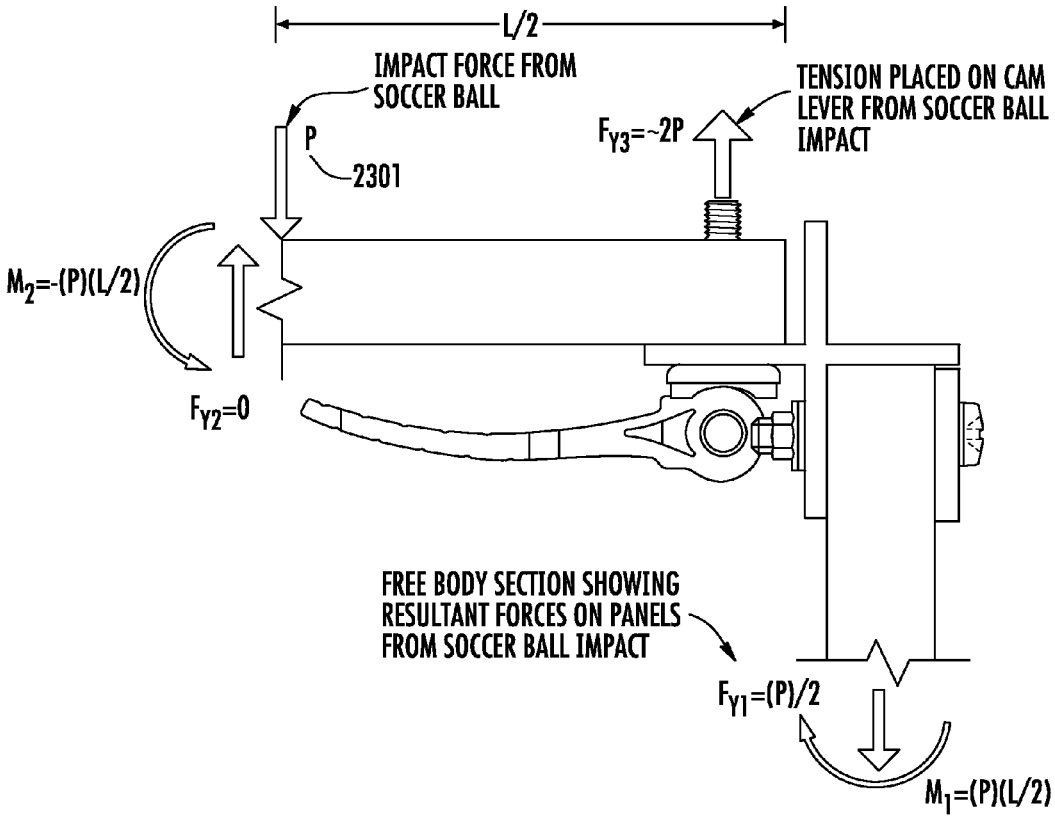
FIG. 23 shows a free body diagram of tension forces on a cam lever.

FIG. 23 shows a free body diagram of tension forces on a cam lever. An impact force 2301 is applied to a wall of the product. As a result, it is estimated that a well struck ball intended to travel 25 yards would only generate approximately 110 pounds force, which, if struck perfectly against the product, would barely generate enough force to lift the front edge from the ground. As a result, it will be extremely difficult to even lift the front edge of the product from the ground by kicking a soccer ball against the panel.

Because shear resistance will depend upon the surface upon which the product is placed, it is not possible to quantify or estimate the product's resistance to shear stresses. However, the design of the product using FRP reduces the shear resistance needed to prevent movement of the product by reducing the actual impact force on the panel.

Based upon the above estimates of force imparted on the panel of the product a well struck soccer ball, it is important to ensure that the cam levers are capable of providing adequate clamping forces to offset these forces and maintain a rigid end connection. FIG. 23 shows a free body diagram of the connection between the panels and the cam levers as well as the resultant forces on the cam lever as a function of the impact load from the soccer ball.

As can be seen from the free body diagram, the forces acting upon the cam lever from are approximately twice that of the impact force from the soccer ball. Therefore, in the case above where the soccer ball imparted 110 pounds force on the panel, there would be approximately 220 pounds force of tension placed upon the cam lever.

Manufacturer information for the cam levers indicates the cam levers are capable of exerting 1,124 pounds of clamping force, which is much more than necessary to maintain a rigid connection between adjacent panels.

Figure 24:
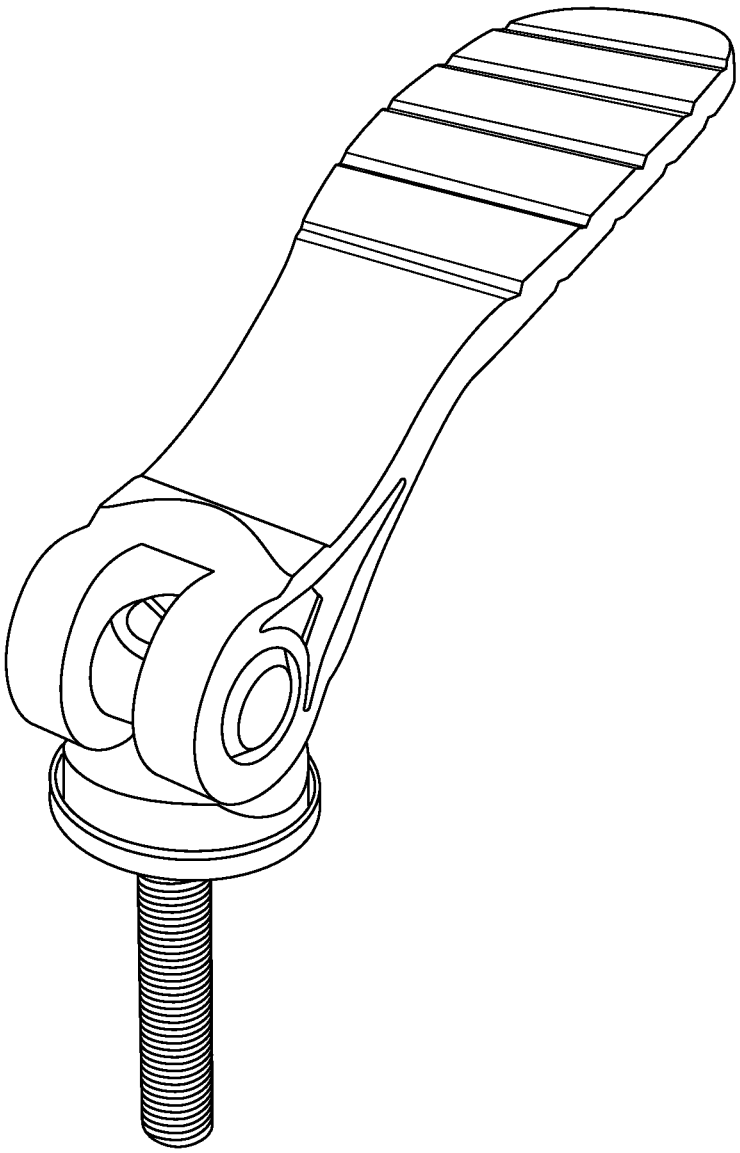
FIG. 24 shows a picture of a quick-connection.

In an implementation, the product uses cam levers at each of the four corners of the box to join perpendicular panels to each other. These cam levers function by tightening the connection through cam and lever rather than a screw type apparatus. Screwing the cam lever a small amount and then pushing the cam lever into the closed position generates a substantial amount of clamping force. FIG. 24 shows a picture of a quick-connection, cam lever.

Additionally, the cam levers are capable of generating over 1,000 pounds of clamping force, which as shown in the drawing below, is more than adequate to maintain the fixed-end beam characteristics of the product.

The result of using the cam lever is that the panels can be assembled and disassembled very quickly when compared to prior art that only contemplated the use of screwed type fittings. Such screwed type fittings, although removable, would consume a substantial amount of time compared to the use of cam levers. The speed at which these cam lever fittings allow for the assembly and disassembly of the Product represents a significant improvement in the previous art of the product.

Field tests of the assembly and disassembly time of the product were conducted with soccer coaches that were only shown a single demonstration of the connection procedures for one corner of the product. The assembly and disassembly times for each coach was then measured by providing the coach with all four panels stacked on top of each other. The coach was then required to assemble each panel without assistance and subsequently disassemble each panel and return them to the stacked position. A sample set of these times to perform these tasks is shown below.

TABLE 4

Assembly and Disassembly Times of Product

| Coach | Assembly Time First Attempt (mm:ss) | Disassembly Time First Attempt (mm:ss) |
|---|---|---|
| Coach 1 | 02:43 | 00:43 |
| Coach 2 | 01:45 | 00:36 |
| Coach 3 | 02:35 | 00:30 |
| Coach 4 | 01:06 | 00:31 |
| Coach 5 | 01:16 | 00:20 |
| Parent 1 | 01:12 | 00:40 |
| Parent 2 | 01:00 | 00:22 |

The product can be included as a kit. The kit can include an attachment mechanism (e.g., strap, box, case, bag, pouch) to removably fasten the panels and keep the panels together. For example, when the panels are disassembled, this attachment mechanism holds the panels together for easier transport by keep the panels together and minimizing the space necessary to transport and store the product.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A device for soccer training comprising:

a first, second, third, and fourth panels, each panel comprising:

a grating comprising a plurality of bars extending in a first direction wherein a surface of the plurality of bars are substantially planar, thereby forming a planar front rebounding surface for the panel, a first end formed by the plurality of bars, and a second end, opposite the first end, formed by the plurality of bars;

a first mounting bracket is affixed to a first end of the first panel;

a first cross bracket and a first angle bracket, wherein the first cross bracket and the first angle bracket forms a first slot; and a tightening mechanism coupling the first cross bracket and the first angle bracket comprising:

in a non-tightened position, the first cross bracket and the first angle bracket is ready to receive a first end of a second panel; and in a tightened position, the first cross bracket and the second angle bracket receives and clasps a first end of the second panel at the first slot.

2. The device of claim 1 wherein the first panel comprises a fiberglass reinforced plastic (FRP) material.

3. The device of claim 2 wherein a modulus of elasticity for the first panel is approximately $2.8\times10^{-6}$ pounds per square inch.

4. The device of claim 1 wherein for each of the panels, the plurality of bars are approximately parallel with respect to each other.

5. The device of claim 1 wherein each panel comprises a plurality of panel supports, wherein the panel supports extend in a second direction, perpendicular to the first direction.

6. The device of claim 5 wherein for a first panel, the panel supports are at a rear surface of the first panel, opposite of a planar front rebounding surface of the first panel.

7. The device of claim 5 wherein the plurality of panel supports are adapted to be driven into a ground surface.

8. The device of claim 5 wherein none of the panel supports are positioned at the first or second ends.

9. The device of claim 1 wherein the tightening mechanism is a cam lever.

10. The device of claim 9 wherein in the non-tightened position, the cam lever continues to couple the first cross bracket and the first angle bracket.

11. The device of claim 1 wherein upon an impact at a planar front rebounding surface of one of the panels, the impacted panel exhibits an elastic response.

12. The device of claim 1 wherein the first, second, third, and fourth panels are adapted to receive a kicked ball.

13. The device of claim 12 wherein the first panel is adapted to receive the kicked ball is in a landscape position.

14. The device of claim 12 wherein when the first panel is receiving a kicked ball, the first panel transfers bending movement to second and third panels.

15. The device of claim 1 wherein the tightening mechanism is a quick connector.

16. The device of claim 1 wherein the first panel comprises an anisotropic material.

17. The device of claim 1 wherein the first and second panels are removably coupled.

18. A kit for a soccer training device comprising:

the device of claim 1; and a securing mechanism to removably hold the first, second, third, and fourth panels when the panels are in a non-tightened position.

19. The kit of claim 18 wherein the securing mechanism comprises a handle.

20. The kit of claim 18 wherein the securing mechanism is a strap.

* * * * *